US010321552B2

(12) United States Patent
Kinjo et al.

(10) Patent No.: US 10,321,552 B2
(45) Date of Patent: Jun. 11, 2019

(54) UNDULATOR MAGNET ARRAY AND UNDULATOR

(71) Applicant: RIKEN, Saitama (JP)

(72) Inventors: Ryota Kinjo, Saitama (JP); Takashi Tanaka, Saitama (JP)

(73) Assignee: RIKEN, Saitama (JP)

( * ) Notice: Subject to any disclaimer, the term of this patent is extended or adjusted under 35 U.S.C. 154(b) by 26 days.

(21) Appl. No.: 15/521,240

(22) PCT Filed: Oct. 8, 2015

(86) PCT No.: PCT/JP2015/078601
§ 371 (c)(1),
(2) Date: Apr. 21, 2017

(87) PCT Pub. No.: WO2016/063740
PCT Pub. Date: Apr. 28, 2016

(65) Prior Publication Data

US 2017/0339777 A1 Nov. 23, 2017

(30) Foreign Application Priority Data

Oct. 21, 2014 (JP) ..... 2014-214468

(51) Int. Cl.
*H01F 7/00* (2006.01)
*H05H 7/04* (2006.01)
(Continued)

(52) U.S. Cl.
CPC ..... *H05H 7/04* (2013.01); *G21K 1/003* (2013.01); *H01F 7/0278* (2013.01); *H01F 7/06* (2013.01); *H05H 13/04* (2013.01)

(58) Field of Classification Search
CPC .... H05H 7/04; H01J 37/141; H01J 2237/141; H01J 23/10; H01J 37/317; H01J 1/50;
(Continued)

(56) References Cited

U.S. PATENT DOCUMENTS 5,383,049 A * 1/1995 Carr ..... H05G 2/00 359/283
5,563,568 A * 10/1996 Sasaki ..... H01F 7/0278 315/5.35

(Continued)

FOREIGN PATENT DOCUMENTS

JP 2012-160408 A 8/2012

OTHER PUBLICATIONS

K. Halbach, "Permanent Magnet Undulators", Journal de Physique Colloques, 1983, 44 (C1), pp. C1-211-C1-216. <10.1051/jphyscol:1983120>. <jpa-00222549> (7 pages).

(Continued)

*Primary Examiner* — Shawki S Ismail
*Assistant Examiner* — Lisa N Homza
(74) *Attorney, Agent, or Firm* — Osha Liang LLP

(57) ABSTRACT

In an undulator magnet array, an upper magnet array is formed by coupling an upper shift magnet array and an upper reference magnet array, and a lower magnet array is formed by coupling a lower reference magnet array and lower shift magnet array arranged so as to face the magnet arrays. With reference to a state where the amplitudes of periodic magnetic fields that can be formed by the upper magnet array and the lower magnet array are maximized, the upper shift magnet array is shifted ¼ of a period to the left as seen from the lower reference magnet array and the lower shift magnet array is shifted ¼ of a period to the left as seen from the upper reference magnet array.

8 Claims, 15 Drawing Sheets

(51) Int. Cl.
*H05H 13/04* (2006.01)
*G21K 1/00* (2006.01)
*H01F 7/02* (2006.01)
*H01F 7/06* (2006.01)

(58) Field of Classification Search
CPC ..... H01F 7/00; H01F 7/02; H01F 7/04; H01F 1/053; H01S 3/00; G02B 1/08
USPC ..... 335/210
See application file for complete search history.

(56) References Cited

U.S. PATENT DOCUMENTS 5,714,850 A * 2/1998 Kitamura ..... H05H 7/04 315/5.35
6,057,656 A * 5/2000 Ohashi ..... H01F 7/0278 315/500
6,498,348 B2 * 12/2002 Aitken ..... H01J 37/05 250/396 ML
6,556,595 B2 * 4/2003 Kobayashi ..... H05H 7/04 315/4
6,574,248 B1 * 6/2003 Leupold ..... H01S 3/0903 315/3
9,275,781 B2 * 3/2016 Temnykh ..... H01S 3/0903
9,502,166 B2 * 11/2016 Jeong ..... H05H 7/04
2008/0135775 A1 * 6/2008 Smatlak ..... H01J 37/026 250/396 ML
2015/0129772 A1 * 5/2015 Candler ..... H05H 7/04 250/396 ML
2016/0064129 A1 * 3/2016 Gluskin ..... H01F 7/0231 335/306

OTHER PUBLICATIONS

International Search Report issued in corresponding International Application No. PCT/JP2015/078601 dated Nov. 10, 2015, and English translation thereof (5 pages).

* cited by examiner

PRIOR ART

UNDULATOR MAGNET ARRAY AND UNDULATOR

TECHNICAL FIELD

The present invention relates to an undulator magnet array, and to an undulator incorporating an undulator magnet array.

BACKGROUND ART

In an undulator used to extract synchrotron radiation from an electron beam in a synchrotron radiation facility, there is provided a pair of magnet arrays disposed parallel to and opposite each other to produce a periodic magnetic field, and by undulating electrons that travel between the pair of magnet arrays at a speed close to that of light, intense synchrotron radiation is generated. The periodic magnetic field can be produced with permanent magnets or electromagnets. To obtain synchrotron radiation with a short wavelength in the X-ray region in particular, however, the magnetic field needs to have a period of the order of several centimeters or less, and with electromagnets, it is impossible to produce a magnetic field with sufficient intensity. For this reason, most undulators adopt permanent magnets.

FIG. 22 shows an example of an undulator magnet array used in a conventional undulator. In FIG. 22, the undulator magnet array 901 has a first magnet array 910 and a second magnet array 920. The magnet arrays 910 and 920 each contain four magnets 930 per period $\lambda_u$, and the magnetization direction (indicated by arrows inside the magnets 930) of the magnets 930 contained in each magnet array changes, in the plane through the magnet arrays 910 and 920, by 90° from one magnet to the next (Patent Document 1 and Non-Patent Document 1). Such an undulator magnet array 901 is called, for example, a Halbach magnet array. The electrons traveling between the magnet arrays 910 and 920 at a speed close to that of light are undulated by the action of the periodic magnetic field produced by the magnet arrays 910 and 920 to emit light (synchrotron radiation) with a wavelength λ given by the following equation.

$$\lambda(\lambda_u,B,E)=130\lambda[1+(93.37\lambda_u B)^2/2]/E^2$$

In the above formula, λ is the wavelength of the synchrotron radiation in nanometers (called the fundamental wavelength), $\lambda_u$ is the spatial period of the magnet arrays in meters, B is the amplitude of the magnetic field in tesla, and E is the energy of electrons in gigaelectronvolts.

In a synchrotron radiation facility, the energy of electrons is fixed, and the spatial period is determined during the designing of an undulator; thus, to allow selection of a particular wavelength during the operation of the synchrotron radiation facility, the magnetic field amplitude has to be adjustable. The magnetic field amplitude can be adjusted easily within a certain range by varying the interval, called gap, between the magnet arrays 910 and 920.

LIST OF CITATIONS

Patent Literature

Patent Document 1: Japanese Patent Application published as No. 2012-160408

Non-Patent Literature

Non-Patent Document 1: K. Halbach, "Permanent Magnet Undulators", J. Physique, C1 (1983) 211

SUMMARY OF THE INVENTION

Technical Problem

Inconveniently, the attractive force between magnet arrays containing several hundred to several thousand strong magnets amounts to several tons, and under this attractive force, the above-mentioned adjustment needs to be performed with an accuracy of several micrometers. Accordingly, an undulator uses, all over it, structural materials and driving mechanisms with extremely high rigidity, resulting in a total weight exceeding ten tons. Moreover, distributing loads requires a large number of components, necessitating complex structures and high production and assembly accuracy. All this leads to increased cost and time required for the manufacture, transport, and installation of an undulator.

An object of the present invention is to provide an undulator magnet array and an undulator that contribute to reduction of magnetic forces that act on magnet arrays.

Means for Solving the Problem

According to one aspect of the present invention, an undulator magnet array includes a first magnet array and a second magnet array that are disposed parallel to each other with an interval in between so as to lie opposite each other, and the magnetization direction of magnets contained in the first magnet array and the magnetization direction of magnets contained in the second magnet array change, in the plane through the first and second magnet arrays, periodically along the magnet arrangement direction of the respective magnet arrays. Here, the first magnet array is formed by coupling together a first shifted magnet array and a first reference magnet array each containing a plurality of magnets, and the second magnet array is formed by coupling together a second reference magnet array and a second shifted magnet array each containing a plurality of magnets. Moreover, the first shifted magnet array is disposed opposite the second reference magnet array, the first shifted magnet array being shifted relative to the second reference magnet array by a predetermined shift amount in a predetermined direction parallel to the magnet arrangement direction as compared with in a reference state where the amplitude of the periodic magnetic field produced by the first and second magnet arrays is maximized, and the second shifted magnet array is disposed opposite the first reference magnet array, the second shifted magnet array being shifted relative to the first reference magnet array by the shift amount in the predetermined direction as compared with in the reference state.

The above-mentioned shifting helps reduce the magnetic force that acts between the first and second magnet arrays. The first and second magnet arrays may each be composed of a shifted magnet array, which is shifted, and a reference magnet array, which is unshifted; deposing these in the manner described above permits the cancelling-out of a magnetic force that acts in the magnet arrangement direction as well.

Advantageous Effects of the Invention

According to the present invention, it is possible to provide an undulator magnet array and an undulator that contribute to reduction of magnetic forces that act on magnet arrays

DESCRIPTION OF EMBODIMENTS

Figure 1:
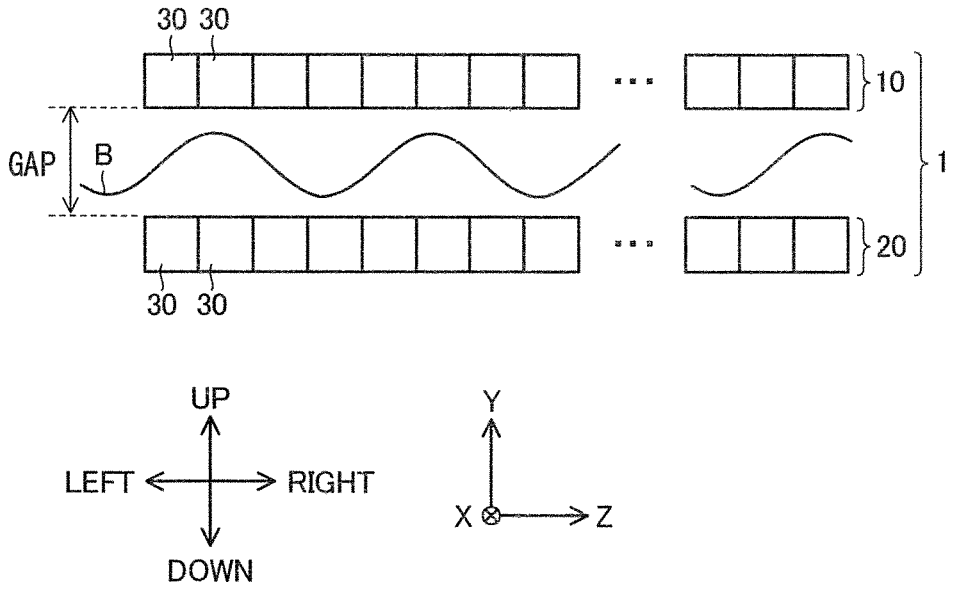
FIG. 1 is a diagram showing an outline of an undulator magnet array according to a first embodiment of the present invention.

Hereinafter, examples embodying the present invention will be described specifically with reference to the accompanying drawings. Among the diagrams referred to, the same parts are identified by the same reference numerals, and in principle no overlapping description of the same parts will be repeated. In the present description, for the sake of simple description, symbols and other designations referring to information, signals, physical quantities, components, and the like are occasionally used alone, while omitting or abbreviating the names of the information, signals, physical quantities, components, and the like that correspond to those symbols and other designations.

First Embodiment

A first embodiment of the present invention will be described. FIG. 1 shows the structure of an undulator magnet array 1 according to the first embodiment. The undulator magnet array 1 has two magnet arrays 10 and 20 disposed parallel to each other with an interval in between so as to lie opposite each other. The magnet arrays 10 and 20 are each composed of a plurality of magnets 30 arranged in a straight line. The magnets 30 are permanent magnets such as neodymium magnets. Unless otherwise stated, the magnets 30 that constitute the magnet arrays 10 and 20 all have the same shape and the same size, and in each magnet array, the plurality of magnets 30 are arranged at a constant pitch.

In this embodiment, for the sake of concrete explanation, three mutually perpendicular axes are assumed, namely X-axis, Y-axis, and Z-axis. Z-axis is parallel to the arrangement direction of the magnets 30 in each magnet array. The arrangement direction of the magnets 30 is the same between the magnet arrays 10 and 20. Y-axis is parallel to the direction connecting between the magnet arrays 10 and 20. The plane parallel to both X-axis and Y-axis will be called XY-plane, the plane parallel to both Y-axis and Z-axis will be called YZ-plane, and the plane parallel to both Z-axis and X-axis will be called ZX-plane. YZ-plane is the plane through the magnet arrays 10 and 20. More precisely, the center of all the magnets 30 constituting the magnet arrays 10 and 20 lies on YZ-plane.

Moreover, what are meant by "up", "down", "left", "right", and similar terms are defined as follows. The left-right direction is parallel to Z-axis, the positive side along Z-axis being the "right" side, the negative side along Z-axis being the "left" side. The up-down direction is parallel to Y-axis, the positive side along Y-axis being the "up" side, the negative side along Y-axis being the "down" side. Furthermore, of two given magnet arrays, the one located relatively above the other will be called the upper magnet array (example of first magnet array), and the one located relatively below the other will be called the lower magnet array (example of second magnet array). Specifically, here, the magnet array 10 is considered to be located above the magnet array 20. Accordingly, in the following description, the magnet arrays 10 and 20 are occasionally called the upper magnet array 10 and the lower magnet array 20 respectively.

Of any given magnet such as the magnets 30, the direction pointing from the S pole to the N pole of the magnet will be called its magnetization direction (the direction in which it is magnetized). Though not clear from FIG. 1 (see, for example, FIG. 2), the magnetization direction of the plurality of magnets 30 contained in the magnet array 10, and likewise the magnetization direction of the plurality of magnets 30 contained in the magnet array 20, changes, in the YZ-plane, that is, in the plane through the magnet arrays 10 and 20, periodically along the direction parallel to Z-axis. The period (spatial period) of the change of the magnetization direction of the magnets 30 in each magnet array (10, 20) is represented by $\lambda_u$. The period $\lambda_u$ is common to the magnet arrays 10 and 20, and is, for example, about several tens of mm (millimeters).

The magnetic field produced by the magnet arrays 10 and 20 will be called the undulator magnetic field B. It should be noted that what is called the undulator magnetic field B here is, of the entire magnetic field produced by the magnet arrays 10 and 20, that component which is perpendicular to the electron beam axis on the electron beam axis. The electron beam axis is the axis of the electron beam that travels between the magnet arrays 10 and 20. The electron beam axis is parallel to Z-axis, and runs through the middle between the magnet arrays 10 and 20. The direction and magnitude of the undulator magnetic field B changes periodically along Z-axis, and in FIG. 1, the periodic change of the undulator magnetic field B is depicted by a curve between the magnet arrays 10 and 20. The void between the magnet arrays 10 and 20 in the Y-axis direction is called the gap.

Basic Configuration

In this embodiment, peculiar magnet arrangements in the undulator magnet array 1 will be described. First, with reference to FIG. 2, as a reference example of the undulator magnet array 1, the configuration of an undulator magnet array $\mathbf{1}_{REF}$ will be described. The undulator magnet array $\mathbf{1}_{REF}$ includes magnet arrays $\mathbf{10}_{REF}$ and $\mathbf{20}_{REF}$ as a reference example of the magnet arrays 10 and 20. It should be noted that, in FIG. 2 as well as in any diagram referred to later that shows an undulator magnet array, only part of all the magnets 30 constituting it are illustrated.

The undulator magnet array $\mathbf{1}_{REF}$ is a Halbach magnet array, and contains four magnets 30 per period $\lambda_u$. In any diagram including FIG. 2 that show magnets (such as the magnets 30), their magnetization direction is indicated by arrows inside the magnets (such as the magnets 30).

Figure 2:
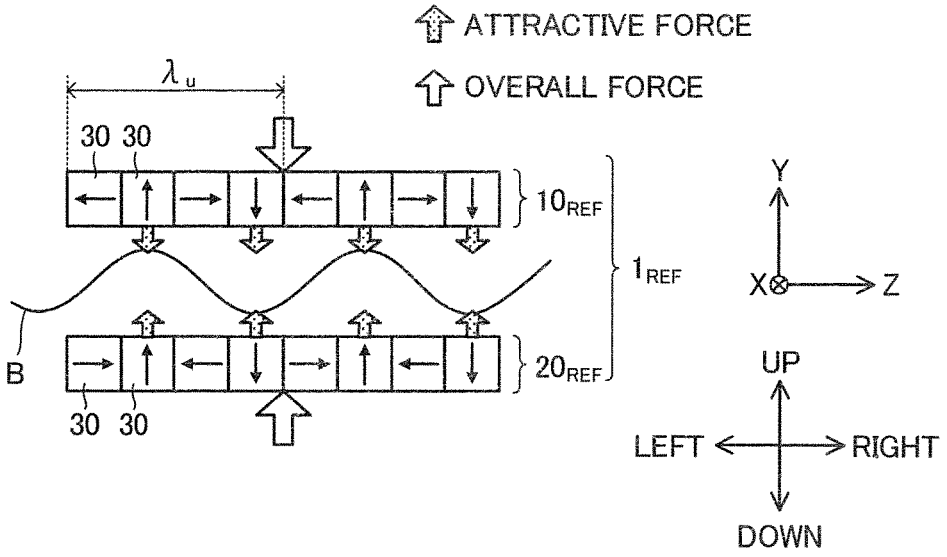
FIG. 2 is a diagram showing a reference configuration of the undulator magnet array according to the first embodiment of the present invention.
Figure 3A:
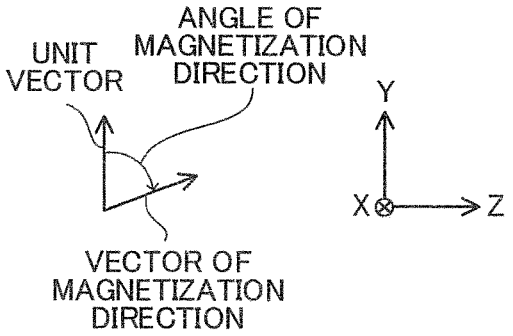
FIG. 3A and FIG. 3B are diagrams illustrating the angle of the magnetization direction of magnets.

Referring to FIG. 3A, assume a reference vector that is parallel to Y-axis and that, starting at the origin of Y-axis, points to the positive side along Y-axis; then the angle of a vector representing a magnetization direction to the reference vector will be called the angle of the magnetization direction. The angle of a magnetization direction is 0° or more but less than 360°. Accordingly, if a given magnetization direction coincides with the direction pointing from the negative to the positive side along Y-axis, the angle of the magnetization direction is 0°; if a given magnetization direction coincides with the direction pointing from the positive to the negative side along Y-axis, the angle of the magnetization direction is 180°. Here, with respect to the reference vector, the angle of a magnetization direction is counted clockwise in the plane of FIG. 2. That is, if a given magnetization direction coincides with the direction pointing from the negative to the positive side along Z-axis, the angle of the magnetization direction is 90°; if a given magnetization direction coincides with the direction pointing from the positive to the negative side along Z-axis, the angle of the magnetization direction is 270°.

Figure 3B:
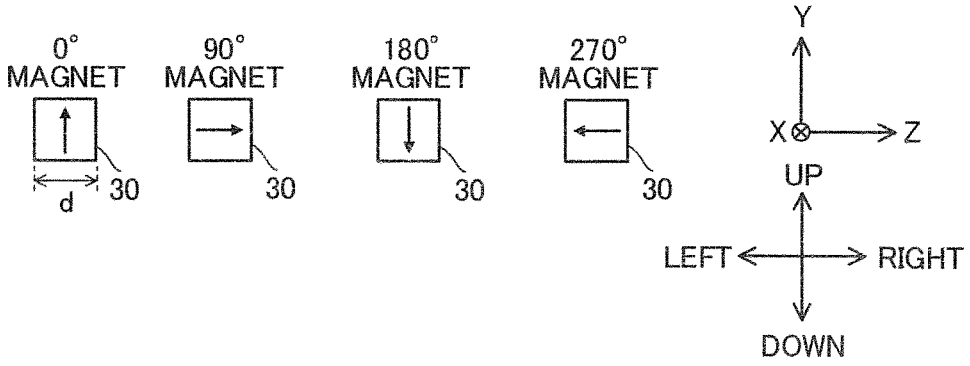

In the undulator magnet array $\mathbf{1}_{REF}$, the number M of magnets 30 present in one period $\lambda_u$ is four, and thus, in each of the magnet arrays $\mathbf{10}_{REF}$ and $\mathbf{20}_{REF}$, the magnetization direction of the magnets 30 changes in YZ-plane by 90° (=360°/M) from one magnet to the next along the direction parallel to Z-axis. Here, the direction of the change is opposite between the upper and lower magnet arrays $\mathbf{10}_{REF}$ and $\mathbf{20}_{REF}$. In the following description, as shown in FIG. 3B, a magnet 30 of which the angle of the magnetization direction is θ is designated as a θ magnet 30. The width of a magnet 30 in the Z-axis direction is represented by the symbol "d".

In the magnet array $\mathbf{10}_{RFF}$, from left to right, 0°, 90°, 180°, and 270° magnets 30 are arranged in this order, in repeated cycles, four successive magnets 30 forming a magnet array corresponding to one period. Accordingly, with the center of the 0° magnet 30 in the magnet array $\mathbf{10}_{REF}$ taken as the origin of Z-axis, the centers of the 0°, 90°, 180°, and 270° magnets 30 in the magnet array $\mathbf{10}_{REF}$ are located at the positions away from the origin rightward in the Z-axis direction by distances of (i×4)×d, (i×4+1)×d, (i×4+2)×d, and (i×4+3)×d respectively (where i is an integer).

In the magnet array $\mathbf{20}_{REF}$, from left to right, 0°, 270°, 180°, and 90° magnets 30 are arranged in this order, in repeated cycles, four successive magnets 30 forming a magnet array corresponding to one period. Accordingly, with the center of the 0° magnet 30 in the magnet array $\mathbf{20}_{REF}$ taken as the origin of Z-axis, the centers of the 0°, 270°, 180°, and 90° magnets 30 in the magnet array $\mathbf{20}_{REF}$ are located at the positions away from the origin rightward in the Z-axis direction by distances of (i×4)×d, (i×4+1)×d, (i×4+2)×d, and (i×4+3)×d respectively.

Here, at the positions opposite the 0°, 90°, 180°, and 270° magnets 30 in the magnet array $\mathbf{10}_{REF}$, the 0°, 270°, 180°, and 90° magnets 30 in the magnet array $\mathbf{20}_{REF}$ are disposed respectively. More specifically, the straight line connecting between the center position of the i-th magnet in the magnet array $\mathbf{10}_{REF}$ and the center position of the i-th magnet in the magnet array $\mathbf{20}_{REF}$ is parallel to Y-axis, the first to fourth magnets in the magnet array $\mathbf{10}_{REF}$ being 0°, 90°, 180°, and 270° magnets 30 respectively, the first to fourth magnets in the magnet array $\mathbf{20}_{REF}$ being 0°, 270°, 180°, and 90° magnets 30 respectively.

In any diagram including FIG. 2 that shows magnets (such as the magnets 30), an attractive force that acts on a pair of magnets is indicated by a dot-filled arrow. In FIG. 2, attractive forces are indicated exclusively for those pairs of magnets which have a magnetization direction of 0° and those pairs of magnets which have a magnetization direction of 180° (the same applies to FIG. 4 and the like referred to later). In any diagram including FIG. 2 that shows an undulator magnet array, an overall force that acts on the upper and lower magnet arrays is indicated by a hollow arrow. In the undulator magnet array $\mathbf{1}_{REF}$ presented as the reference, a strong attractive force acts between the magnet arrays $\mathbf{10}_{REF}$ and $\mathbf{20}_{REF}$.

First Improved Configuration

A first improved configuration of the undulator magnet array will be described. An undulator magnet array $\mathbf{1}_A$ shown in FIG. 4 according to the first improved configuration is an example of the undulator magnet array 1, and includes an upper magnet array $\mathbf{10}_A$ and a lower magnet array $\mathbf{20}_A$ as an example of the upper and lower magnet arrays 10 and 20 respectively. The upper magnet array $\mathbf{10}_A$ itself is configured similarly to the upper magnet array $\mathbf{10}_{REF}$ described previously, and the lower magnet array $\mathbf{20}_A$ itself is configured similarly to the lower magnet array $\mathbf{20}_{REF}$ described previously.

However, in the undulator magnet array $\mathbf{1}_A$, as compared with the undulator magnet array $\mathbf{1}_{REF}$, the upper magnet array is disposed, relative to the lower magnet array, with a leftward displacement corresponding one-fourth of the period $\lambda_u$. In the following description, for the sake of convenient description, displacing by a distance corresponding to one w-th of the period $\lambda_u$ is occasionally described as shifting by one w-th of the period (where w is a real number). In the undulator magnet array $\mathbf{1}_A$, as compared with the undulator magnet array $\mathbf{1}_{REF}$, the upper magnet array is shifted leftward by one-fourth of the period relative to the lower magnet array.

Accordingly, at the positions opposite the 0°, 90°, 180°, and 270° magnets 30 in the magnet array $\mathbf{10}_A$, the 90°, 0°, 270°, and 180° magnets 30 in the magnet array $\mathbf{20}_A$ are disposed respectively. More specifically, the straight line connecting between the center position of the i-th magnet in the magnet array $\mathbf{10}_A$ and the center position of the i-th magnet in the magnet array $\mathbf{20}_A$ is parallel to Y-axis, the first to fourth magnets in the magnet array $\mathbf{10}_A$ being 0°, 90°, 180°, and 270° magnets 30 respectively, the first to fourth magnets in the magnet array $\mathbf{20}_A$ being 90°, 0°, 270°, and 180° magnets 30 respectively.

Figure 4:
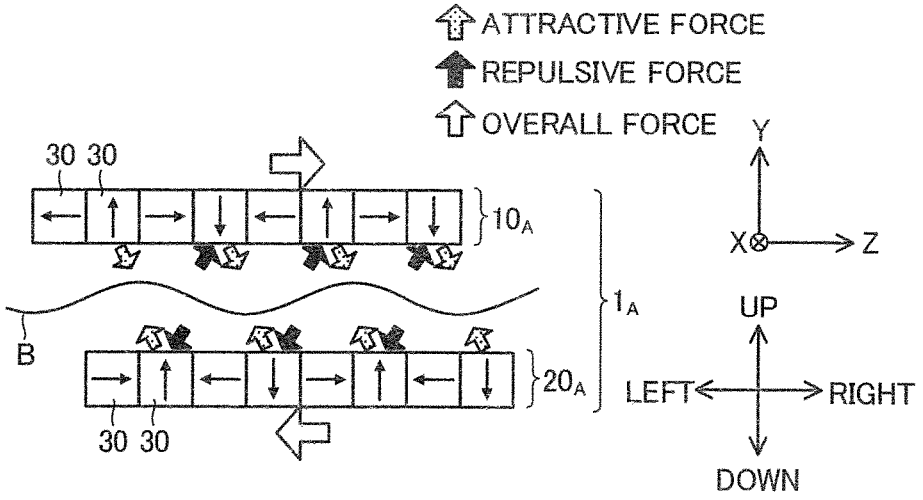
FIG. 4 is a diagram showing a first improved configuration of the undulator magnet array according to the first embodiment of the present invention.

In any diagram including FIG. 4 that shows magnets (such as the magnets 30), a repulsive force that acts on a pair of magnets is indicated by a solid black arrow. In FIG. 4, repulsive forces are indicated exclusively for those pairs of magnets 30 which contain 0° and 180° magnets 30 (the same applies to FIG. 5 and the like referred to later).

Figure 5:
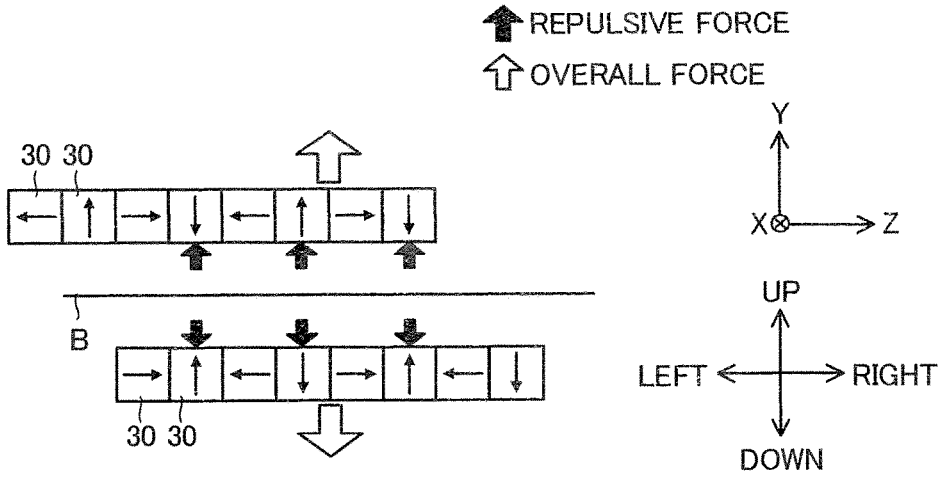
FIG. 5 is a diagram showing the configuration of an undulator magnet array for comparison with the undulator magnet array of the first improved configuration.

The magnetic circuit formed by the configuration of FIG. 4 is considered to be the middle one between the magnetic circuit formed by the configuration of FIG. 2 and the magnetic circuit formed by the configuration of FIG. 5. In the configuration of FIG. 5, as compared with the undulator magnet array $\mathbf{1}_{REF}$, the upper magnet array is shifted leftward by one-half of the period (that is, by the distance corresponding to one-half of the period $\lambda_u$) relative to the lower magnet array, with the result that repulsive forces act between the upper and lower magnet arrays.

In the magnetic circuit formed by the configuration of FIG. 2 (that is, in the undulator magnet array $\mathbf{1}_{REF}$ as the reference), the amplitude of the undulator magnetic field B (that is, the amplitude of the Y-axis component of the undulator magnetic field B of which the direction and magnitude change in the Z-axis direction) is maximized, and in the magnetic circuit formed by the configuration of FIG. 4 (that is, in the undulator magnet array $\mathbf{1}_A$), the amplitude of the undulator magnetic field B is smaller than that in FIG. 2. In the magnetic circuit formed by the configuration of FIG. 5, the amplitude of the undulator magnetic field B is zero.

In the magnetic circuit formed by the configuration of FIG. 4, the upper and lower magnet arrays do not receive any force that acts in the up-down direction. This helps make compact the driving mechanism for varying the gap. This, however, comes at a cost: the upper magnet array as a whole receives a strong rightward force while the lower magnet array as a whole receives a strong leftward force, with the result that the structural components that support the upper and lower magnet arrays are acted on by strong forces in the left-right direction. That is, while size reduction is possible in the driving mechanism for varying the gap, high rigidity is required in the structural components (such as the base 170 in FIG. 19 referred to later) that support the upper and lower magnet arrays.

Second Improved Configuration

Figure 6:
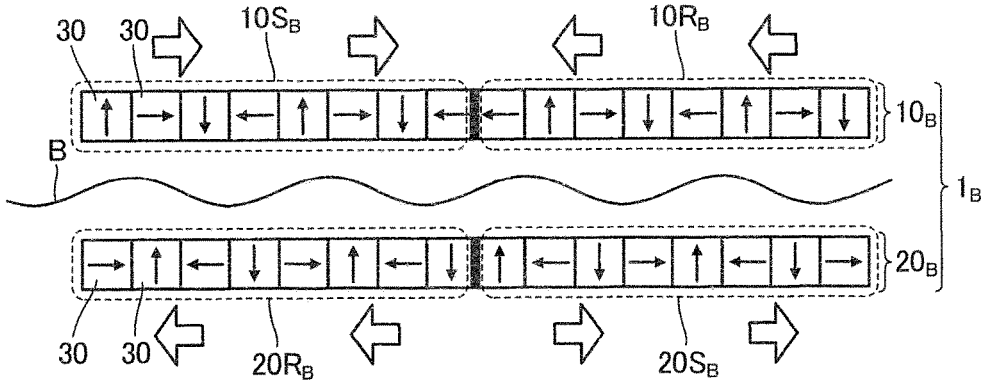
FIG. 6 is a diagram showing a second improved configuration of the undulator magnet array according to the first embodiment of the present invention.

Now, as a second improved configuration, an undulator magnet array $\mathbf{1}_B$ as shown in FIG. 6 will be considered. The undulator magnet array $\mathbf{1}_B$ according to the second improved configuration is an example of the undulator magnet array 1, and includes an upper magnet array $\mathbf{10}_B$ and a lower magnet array $\mathbf{20}_B$ as an example of the upper and lower magnet arrays 10 and 20 respectively. The upper and lower magnet arrays $\mathbf{10}_B$ and $\mathbf{20}_B$ are configured basically similarly to the upper and lower magnet arrays $\mathbf{10}_{REF}$ and $\mathbf{20}_{REF}$ respectively.

However, in the undulator magnet array $\mathbf{1}_B$, as compared with the undulator magnet array $\mathbf{1}_{REF}$ as the reference, the left half of the upper magnet array is shifted leftward by one-fourth of the period (that is, by the distance corresponding to one-fourth of the period $\lambda_u$) relative to the lower magnet array, and in addition the right half of the lower magnet array is shifted leftward by one-fourth of the period (that is, by the distance corresponding to one-fourth of the period $\lambda_u$) relative to the upper magnet array. As a result of not the upper magnet array but the lower magnet array being shifted in the right half, the periodicity of the undulator magnetic field B is preserved.

Figure 7:
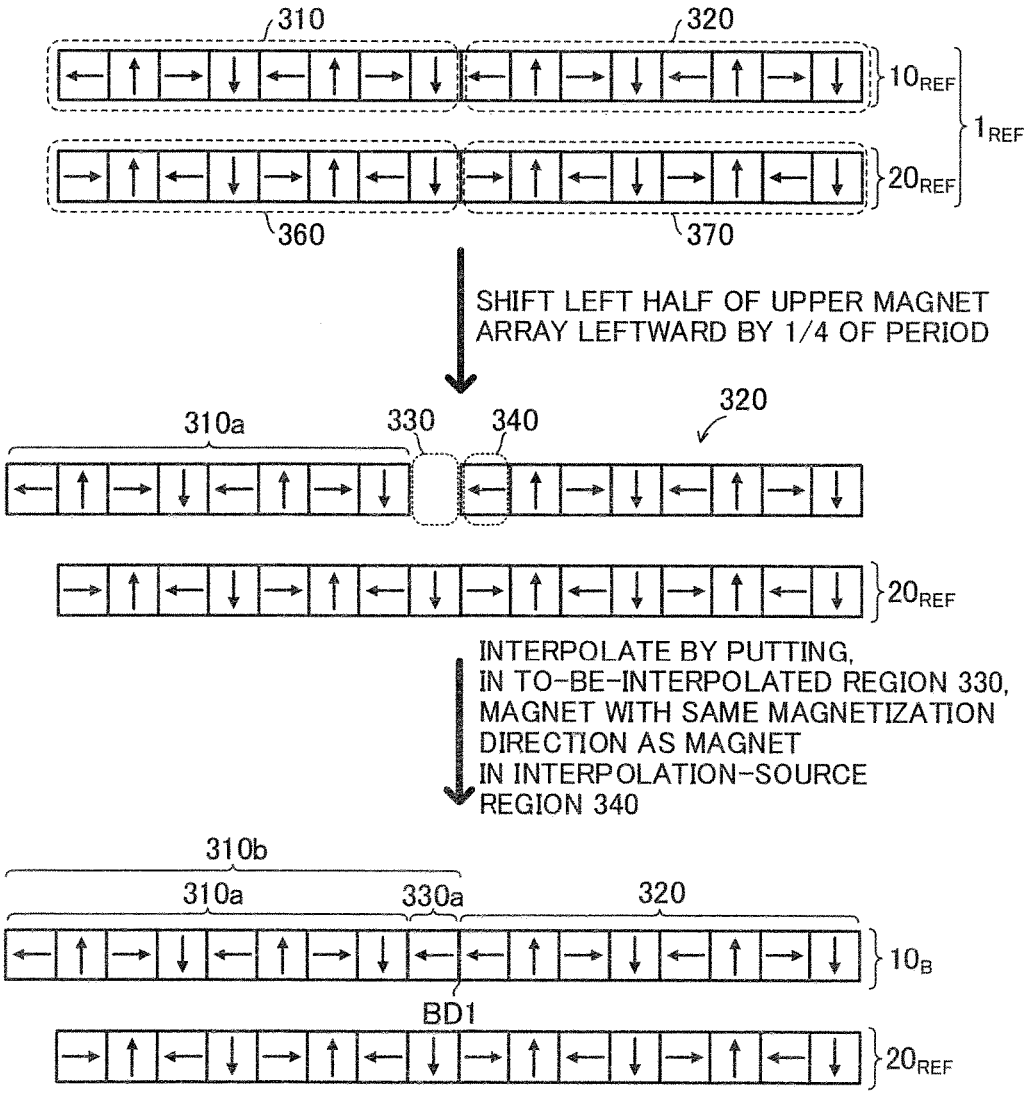
FIG. 7 is a diagram illustrating a procedure for fabricating the undulator magnet array of the second improved configuration.
Figure 8:
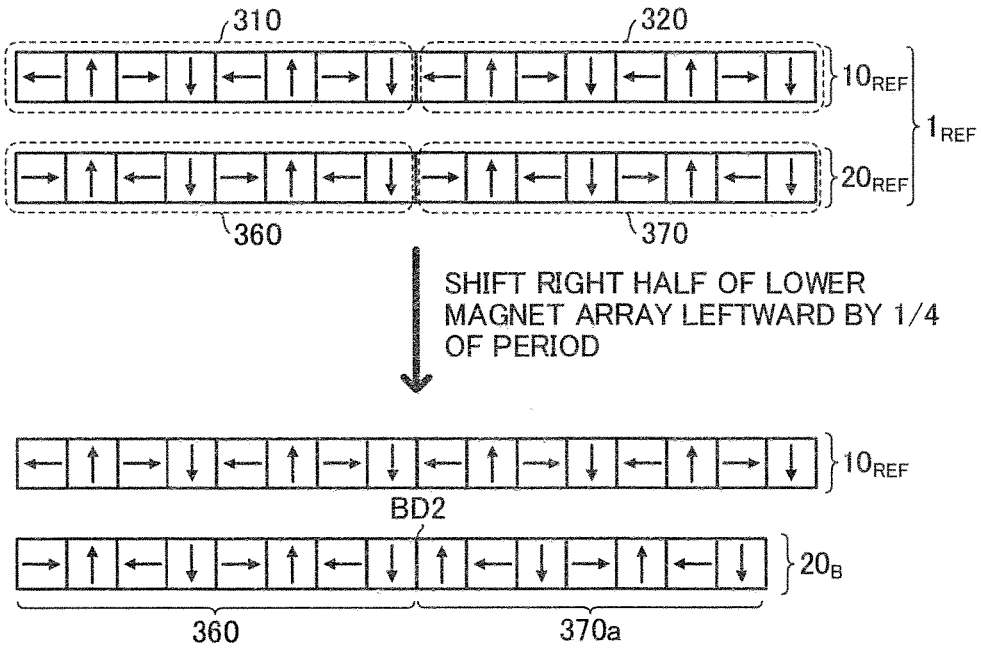
FIG. 8 is a diagram illustrating a procedure for fabricating the undulator magnet array of the second improved configuration.

With reference to FIGS. 7 and 8, the configuration of the undulator magnet array $\mathbf{1}_B$ will be described. FIGS. 7 and 8 show a procedure for fabricating the undulator magnet array $\mathbf{1}_B$ starting with the undulator magnet array $\mathbf{1}_{REF}$. In the undulator magnet array $\mathbf{1}_{REF}$, the left and right halves of the upper magnet array $\mathbf{10}_{REF}$ will be called the magnet arrays 310 and 320 respectively, and the left and right halves of the lower magnet array $\mathbf{20}_{REF}$ will be called the magnet arrays 360 and 370 respectively.

First, as shown in FIG. 7, starting with the undulator magnet array $\mathbf{1}_{REF}$, the left-half magnet array 310 of the upper magnet array $\mathbf{10}_{REF}$ is shifted leftward by one-fourth of the period relative to the lower magnet array $\mathbf{20}_{REF}$. In FIG. 7, the magnet array 310 after being so shifted is depicted as a magnet array 310*a*. As a result of the shifting, between the left-half magnet array 310*a* of the upper magnet array and the right-half magnet array 320 of the upper magnet array, a void corresponding to one-fourth of the period $\lambda_u$, is left as a to-be-interpolated region 330. In this to-be-interpolated region 330, a magnet 30 having the same magnetization direction as the magnet 30 in an interpolation-source region 340 is disposed for interpolation. The magnet disposed for interpolation is depicted as a magnet 330*a*. The interpolation-source region 340 is the region located between the left end of the magnet array 320 and the position displaced rightward from that left end by a distance corresponding to $\lambda_u/4$. The magnet array composed of the magnet array 310*a* and the magnet 330*a* will be identified as a magnet array 310*b*. Coupling together the magnet arrays 310*b* and 320 at their boundary plane, referred to as the coupling plane BD1, forms the upper magnet array $\mathbf{10}_B$.

On the other hand, as shown in FIG. 8, starting with the undulator magnet array $\mathbf{1}_{REF}$, the right-half magnet array 370 of the lower magnet array $\mathbf{20}_{REF}$ is shifted leftward by one-fourth of the period relative to the upper magnet array $\mathbf{10}_{REF}$. In FIG. 7, the magnet array 370 after being so shifted is depicted as a magnet array 370*a*. Shifting the magnet array 370 leftward causes a magnet 30 near the left end of the magnet array 370 to have to overlap a magnet 30 near the right end of the magnet array 360; this is coped with by removing, out of the magnets 30 in the magnet array 370, the magnet 30 which the above shifting causes to have to overlap one in the magnet array 360. Coupling together the magnet arrays 360 and 370*a* at their boundary plane, referred to as the coupling plane BD2, forms the lower magnet array $\mathbf{20}_B$.

By combining together the upper and lower magnet arrays $\mathbf{10}_B$ and $\mathbf{20}_B$ with the coupling planes BD1 and BD2 shown in FIGS. 7 and 8, respectively, aligned at the same position in the Z-axis direction, the undulator magnet array $\mathbf{1}_B$ is formed. The shifting of the magnet arrays 310 and 370 leaves the upper magnet array to protrude one-fourth of the period beyond the lower magnet array at the left and right ends of the undulator magnet array; such protrusions can be trimmed off in fabricating the undulator magnet array $\mathbf{1}_B$.

In the magnetic circuit formed by the undulator magnet array $\mathbf{1}_B$ in FIG. 6, in each of the magnet arrays $\mathbf{10}_B$ and $\mathbf{20}_B$, the forces acting in the left-right direction are canceled out. Thus, while compressive and tensile forces in the Z-axis direction act only on those structural components which hold the magnet arrays integrally (such as the magnet array beams 110 and 120 in FIG. 19 referred to later), no magnetic force acts on those structural components which support the upper and lower magnet arrays (such the base 170 in FIG. 19 referred to later). Thus, as compared with in a case where the undulator magnet array $\mathbf{1}_{REF}$ as the reference is used, it is possible to reduce the rigidity required in the structural components that support the upper and lower magnet arrays, and hence to greatly reduce the weight of an undulator as a whole.

Starting with the undulator magnet array $\mathbf{1}_{REF}$, of the upper magnet array, the part that is shifted leftward relative to the lower magnet array will be called the upper shifted magnet array (example of first shifted magnet array), and the unshifted part will be called the upper reference magnet array (example of first reference magnet array). Likewise, starting with the undulator magnet array $\mathbf{1}_{REF}$, of the lower magnet array, the part that is shifted leftward relative to the upper magnet array will be called the lower shifted magnet array (example of second shifted magnet array), and the unshifted part will be called the lower reference magnet array (example of second reference magnet array). In the example in FIGS. 7 and 8, the magnet arrays 310*b* and 320 correspond to the upper shifted and reference magnet arrays respectively, and the magnet arrays 370*a* and 360 correspond to the lower shifted and reference magnet arrays respectively. In the example in FIG. 6, the magnet arrays $\mathbf{10S}_B$ and $\mathbf{10R}_B$ correspond to the upper shifted and reference magnet arrays respectively, and the magnet arrays $\mathbf{20S}_B$ and $\mathbf{20R}_B$ correspond to the lower shifted and reference magnet arrays respectively.

The upper magnet array $\mathbf{10}_B$ is formed by coupling together the upper shifted and reference magnet arrays $\mathbf{10S}_B$ and $\mathbf{10R}_B$, and the lower magnet array $\mathbf{20}_B$ is formed by coupling together the lower reference and shifted magnet arrays $\mathbf{20R}_B$ and $\mathbf{20S}_B$. In FIG. 6, bold-line arrows schematically indicate how forces act on where the upper shifted and reference magnet arrays are coupled together and where the lower reference and shifted magnet arrays are coupled together (the same applied to FIG. 9 and the like referred to later).

The upper shifted magnet array is disposed opposite the lower reference magnet array (the same applies to any later-described undulator magnet array that includes an upper shifted magnet array and a lower reference magnet array). That is, in the undulator magnet array $\mathbf{1}_B$, at the positions opposite the 0°, 90°, 180°, and 270° magnets 30 in the upper shifted magnet array $\mathbf{10S}_B$, the 90°, 0°, 270°, and 180° magnets 30 in the lower reference magnet array $\mathbf{20R}_B$ are disposed respectively. More specifically, the straight line connecting between the center position of the i-th magnet in the upper shifted magnet array $\mathbf{10S}_B$ and the center position of the i-th magnet in the lower reference magnet array $\mathbf{2R}_B$ is parallel to Y-axis, the first to fourth magnets in the upper shifted magnet array $\mathbf{10S}_B$ being 0°, 90°, 180°, and 270° magnets 30 respectively, the first to fourth magnets in the lower reference magnet array $\mathbf{20R}_B$ being 90°, 0°, 270°, and 180° magnets 30 respectively.

The lower shifted magnet array is disposed opposite the upper reference magnet array (the same applies to any later-described undulator magnet array that includes a lower shifted magnet array and an upper reference magnet array). That is, in the undulator magnet array $\mathbf{1}_B$, at the positions opposite the 0°, 270°, 180°, and 90° magnets 30 in the lower shifted magnet array $\mathbf{20S}_B$, the 270°, 0°, 90°, and 180° magnets 30 in the upper reference magnet array $\mathbf{10R}_B$ are disposed respectively. More specifically, the straight line connecting between the center position of the i-th magnet in the lower shifted magnet array $\mathbf{20S}_B$ and the center position of the i-th magnet in the upper reference magnet array $\mathbf{10R}_B$ is parallel to Y-axis, the first to fourth magnets in the lower shifted magnet array $\mathbf{20S}_B$ being 0°, 270°, 180°, and 90° magnets 30 respectively, the first to fourth magnets in the upper reference magnet array $\mathbf{10R}_B$ being 270°, 0°, 90°, and 180° magnets 30 respectively.

Third Improved Configuration

A third improved configuration of the undulator magnet array will be described. An undulator magnet array $\mathbf{1}_C$ shown in FIG. 9 according to the third improved configuration is an example of the undulator magnet array 1, and includes an upper magnet array $\mathbf{10}_C$ and a lower magnet array $\mathbf{20}_C$ as an example of the upper and lower magnet arrays 10 and 20 respectively. The upper and lower magnet arrays $\mathbf{10}_C$ and $\mathbf{20}_C$ are configured basically similarly to the magnet arrays $\mathbf{10}_{REF}$ and $\mathbf{20}_{REF}$, and to them, the technique of shifting magnet arrays described previously in connection with the second improved configuration is applied. Moreover, in the third improved configuration, the upper magnet array $\mathbf{10}_C$ includes a plurality of upper shifted magnet arrays and a plurality of upper reference magnet arrays, and the lower magnet array $\mathbf{20}_C$ includes a plurality of lower reference magnet arrays and a plurality of lower shifted magnet arrays.

The configuration of the undulator magnet array $\mathbf{1}_C$ will now be described more specifically. The upper magnet array $\mathbf{10}_C$ is formed by coupling together a plurality of upper shifted magnet arrays $\mathbf{10S}_C$ and a plurality of upper reference magnet arrays $\mathbf{10R}_C$, and the lower magnet array $\mathbf{20}_C$ is formed by coupling together a plurality of lower shifted magnet arrays $\mathbf{20S}_C$ and a plurality of lower reference magnet arrays $\mathbf{20R}_C$.

In the upper magnet array $\mathbf{10}_C$, the upper shifted and reference magnet arrays $\mathbf{10S}_C$ and $\mathbf{10R}_C$ are disposed alternately. That is, in the upper magnet array $\mathbf{10}_C$, one upper shifted magnet array $\mathbf{10S}_C$ is disposed between one upper reference magnet array $\mathbf{10R}_C$ and another upper reference magnet array $\mathbf{10R}_C$ (assuming that the upper shifted magnet array $\mathbf{10S}_C$ of interest is not located at an end of the upper magnet array $\mathbf{10}_C$), and one upper reference magnet array $\mathbf{10R}_C$ is disposed between one upper shifted magnet array $10S_C$ and another upper shifted magnet array $10S_C$ (assuming that the upper reference magnet array $10R_C$ of interest is not located at an end of the upper magnet array $10_C$).

In the lower magnet array $20_C$, the lower shifted and reference magnet arrays $20S_C$ and $20R_C$ are disposed alternately. That is, in the lower magnet array $20_C$, one lower shifted magnet array $20S_C$ is disposed between one lower reference magnet array $20R_C$ and another lower reference magnet array $20R_C$ (assuming that the lower shifted magnet array $20S_C$ of interest is not located at an end of the lower magnet array $20_C$), and one lower reference magnet array $20R_C$ is disposed between one lower shifted magnet array $20S_C$ and another lower shifted magnet array $20S_C$ (assuming that the lower reference magnet array $20R_C$ of interest is not located at an end of the lower magnet array $20_C$).

Suppose the Z-axis coordinate (position on Z-axis) of the left end of the upper magnet array $10_C$ and the Z-axis coordinate (position on Z-axis) of the left end of the lower magnet array $20_C$ are equal. Then, the j-th upper shifted magnet array $10S_C$ from the left end of the upper magnet array $10_C$ is disposed opposite the j-th lower reference magnet array $20R_C$ from the left end of the lower magnet array $20_C$ (where j is an integer). That is, at the positions opposite the 0°, 90°, 180°, and 270° magnets 30 in the j-th upper shifted magnet array $10S_C$, the 90°, 0°, 270°, and 180° magnets 30 in the j-th lower reference magnet array $20R_C$ are arranged respectively. More specifically, the straight line connecting between the center position of the i-th magnet in the j-th upper shifted magnet array $10S_C$ and the center position of the i-th magnet in the j-th lower reference magnet array $20R_C$ is parallel to Y-axis, the first to fourth magnets in the j-th upper shifted magnet array $10S_C$ being 0°, 90°, 180°, and 270° magnets 30 respectively, the first to fourth magnets in the j-th lower reference magnet array $20R_C$ being 90°, 0°, 270°, and 180° magnets 30 respectively.

The j-th lower shifted magnet array $20S_C$ from the left end of the lower magnet array $20_C$ is disposed opposite the j-th upper reference magnet array $10R_C$ from the left end of the upper magnet array $10_C$. That is, at the positions opposite the 0°, 270°, 180°, and 90° magnets 30 in the j-th lower shifted magnet array $20S_C$, the 270°, 0°, 90°, and 180° magnets 30 in the j-th upper reference magnet array $10R_C$ are arranged respectively. More specifically, the straight line connecting between the center position of the i-th magnet in the j-th lower shifted magnet array $20S_C$ and the center position of the i-th magnet in the j-th upper reference magnet array $10R_C$ is parallel to Y-axis, the first to fourth magnets in the j-th lower shifted magnet array $20S_C$ being 0°, 270°, 180°, and 90° magnets 30 respectively, the first to fourth magnets in the j-th upper reference magnet array $10R_C$ being 270°, 0°, 90°, and 180° magnets 30 respectively.

Figure 9:
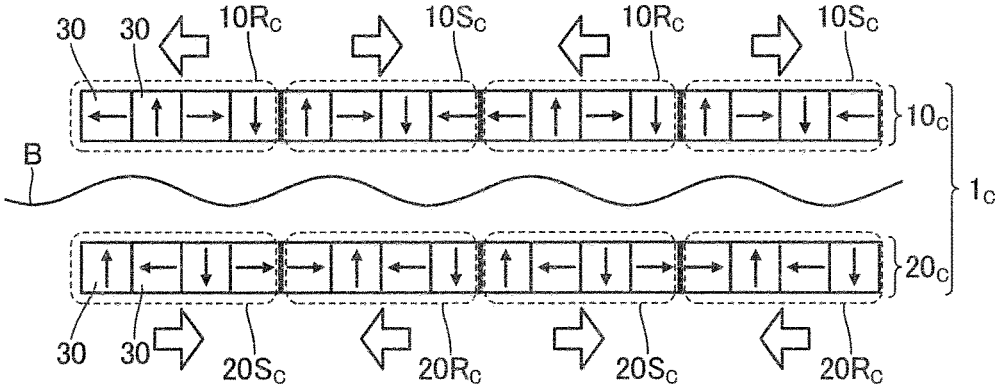
FIG. 9 is a diagram showing a third improved configuration of the undulator magnet array according to the first embodiment of the present invention.

In the example in FIG. 9, shifted and reference magnet arrays alternate every period of arrangement of the magnets 30. That is, in the example in FIG. 9, the magnet arrays $10S_C$, $10R_C$, $20S_C$, and $10R_C$ each contain magnets 30 corresponding to one period, that is, only four magnets 30. Accordingly, a comparison between FIGS. 6 and 9 leads to the following observation: the four magnets 30 from the right end of the upper shifted magnet array $10S_B$ in FIG. 6 form the upper shifted magnet array $10S_C$ in FIG. 9; the four magnets 30 from the right end of the lower reference magnet array $20S_B$ in FIG. 6 form the lower reference magnet array $20R_C$ in FIG. 9; the four magnets 30 from the left end of the upper reference magnet array $10R_B$ in FIG. 6 form the upper reference magnet array $10R_C$ in FIG. 9; and the four magnets 30 from the left end of the lower shifted magnet array $20S_B$ in FIG. 6 form the lower shifted magnet array $20S_C$ in FIG. 9.

Although in the example described above, one upper shifted magnet array, one upper reference magnet array, one lower shifted magnet array, and one lower reference magnet array are each composed of magnets 30 corresponding to one period, each of those magnet arrays may instead be composed of magnets 30 corresponding to a plurality of periods (for example, ten periods).

With the third improved configuration, not only is it possible to obtain the effects and benefits of the second improved configuration, but it is in addition possible to disperse the compressive and tensile forces that act on the structural components (such as the magnet array beams 110 and 120 in FIG. 19 referred to later) that hold the magnet arrays integrally, and also to reduce the rigidity required in those structural components.

Fourth Improved Configuration

Figure 10A:
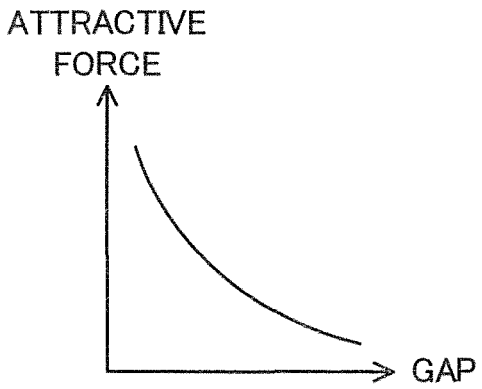
FIGS. 10A, 10B, and 10C are diagrams showing the gap-dependence of the magnetic forces that act between the upper and lower magnet arrays in the first embodiment of the present invention.
Figure 10B:
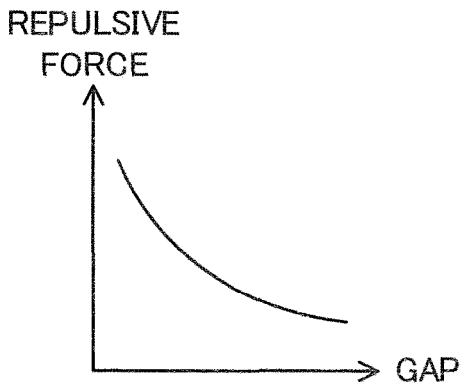
Figure 10C:
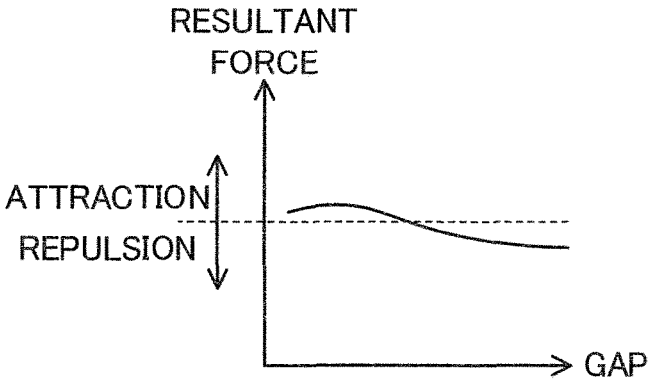

A fourth improved configuration of the undulator magnet array will be described. Through the approaches described previously in connection with the first to third improved configurations, ideally, the attractive and repulsive forces between the upper and lower magnet arrays balance out completely. In reality, however, owing to the magnetic permeability of actual magnets 30 not being equal to one, and also owing to the upper and lower magnet arrays being divided into shifted and reference magnet arrays, the attractive and repulsive forces do not completely balance out, leaving either an attractive force or a repulsive force to appear depending on the gap (see FIG. 10C). This brings about a state where the curve of the dependence of the attractive force on the gap (see FIG. 10A) and the curve of the dependence of the repulsive force on the gap (see FIG. 10B) do not match.

One possible solution is to fine-adjust the attractive and repulsive forces by shifting the upper or lower shifted magnet arrays, which are already shifted by one-fourth of the period, further leftward or rightward from its shifted position by a minute amount. In the fourth improved configuration, such shifting by a minute amount is approximated by rotating the magnetization direction.

Figure 11:
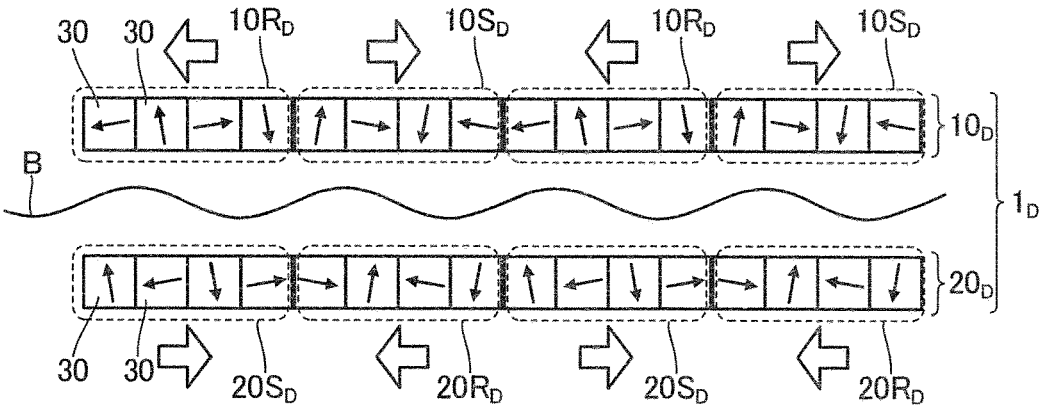
FIG. 11 is a diagram showing a fourth improved configuration of the undulator magnet array according to the first embodiment of the present invention.

An undulator magnet array $1_D$ shown in FIG. 11 according to the fourth improved configuration is an example of the undulator magnet array 1, and includes an upper magnet array $10_D$ and a lower magnet array $20_D$ as an example of the upper and lower magnet arrays 10 and 20 respectively. The upper magnet array $10_D$ is formed by coupling together a plurality of upper shifted magnet arrays $10S_D$ and a plurality of upper reference magnet arrays $10R_D$, and the lower magnet array $20_D$ is formed by coupling together a plurality of lower shifted magnet arrays $20S_D$ and a plurality of lower reference magnet arrays $20R_D$.

By replacing the upper shifted and reference magnet arrays $10S_C$ and $10R_C$ in the upper magnet array $10_C$ in FIG. 9 with upper shifted and reference magnet arrays $10S_D$ and $10R_D$ respectively, the upper magnet array $10_D$ in FIG. 11 is formed. By replacing the lower shifted and reference magnet arrays $20S_C$ and $20R_C$ in the lower magnet array $20_C$ in FIG. 9 with lower shifted and reference magnet arrays $20S_D$ and $20R_D$ respectively, the lower magnet array $20_D$ in FIG. 11 is formed.

In the magnet arrays $10R_C$ and $20S_C$ in FIG. 9, the 0°, 90°, 180°, 270° magnets 30 can be replaced with (360°−Δφ), (90°−Δφ), (180°−Δφ), and (270°−Δφ) magnets 30 respectively, and the magnet arrays $10R_C$ and $20S_C$ having undergone the replacement are the magnet arrays $10R_D$ and $20S_D$ respectively. In the magnet arrays $10S_C$ and $20R_C$ in FIG. 9, the 0°, 90°, 180°, 270° magnets 30 can be replaced with (0°+Δφ), (90°+Δφ). (180°+Δφ), and (270°+Δφ) magnets 30 respectively, and the magnet arrays $10S_C$ and $20R_C$ having undergone the replacement are the magnet arrays $10S_D$ and $20R_D$ respectively. The symbol Δφ represents a predetermined positive angular amount, which is smaller than 90° and is typically a minute angular amount close to 0°. Rotating the magnetization direction by Δφ exerts an effect equivalent to shifting by a minute amount as mentioned above.

The magnetization direction of the magnets 30 is designed to suit the range of the gap in actual use, and by forming the undulator magnet array $1_D$ based on the results of such designing, while the range of the gap is limited, it is possible to bring the attractive and repulsive forces sufficiently close to zero.

Simulations

Next, the details and results of simulations performed with some of the undulator magnet arrays described above will be presented. In these simulations, it was assumed that the period $\lambda_u$ was 18 mm (millimeters) and the total length of the undulator magnet array (its length in the Z-axis direction) was 4.5 m (meters). It was further assumed that the variable range of the gap was 3 to 9 mm, and that the residual flux density and the relative magnetic permeability of the permanent magnets constituting the magnets 30 were 1.2 T (tesla) and 1.06 respectively.

Figure 12:
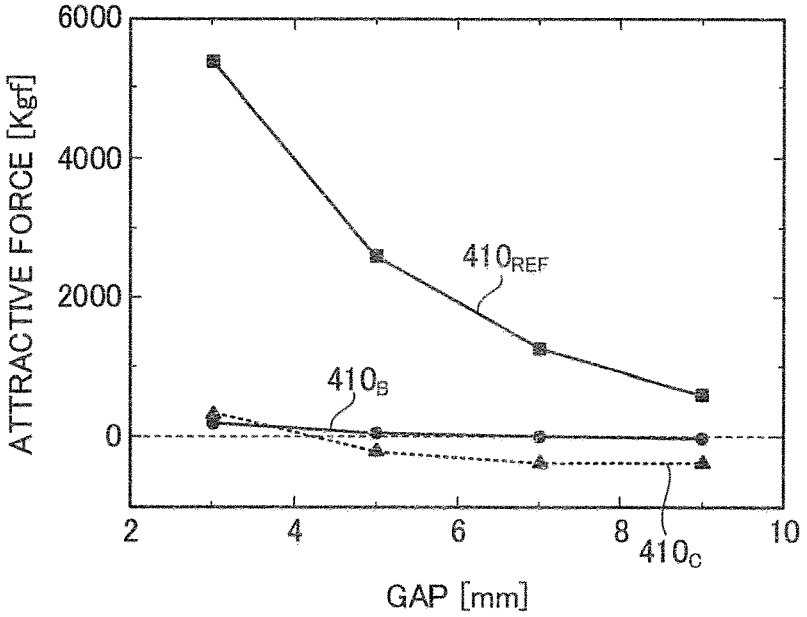
FIG. 12 is a diagram showing the results of simulations according to the first embodiment of the present invention.

FIG. 12 shows the results of a simulation (computation) on the attractive force in an undulator magnet array across different gaps. In FIG. 12, the horizontal axis is a scale of the gap, and the vertical axis is a scale of the attractive force between the upper and lower magnet arrays. Here, a negative attractive force is actually a repulsive force. The solid sequential line $410_{REF}$ represents the results of computation of the attractive force between the upper and lower magnet arrays in the undulator magnet array $1_{REF}$ in FIG. 2. The solid sequential line $410_B$ represents the results of computation of the attractive force between the upper and lower magnet arrays in the undulator magnet array $1_B$ in FIG. 6. The broken sequential line $410_C$ represents the results of computation of the attractive force between the upper and lower magnet arrays in the undulator magnet array $1_C$ in FIG. 9.

With a gap of 3 mm, as compared with the undulator magnet array $1_{REF}$, which exhibited an attractive force of about 5.4 tf (tons-force), the undulator magnet array $1_B$ exhibited an attractive force of about 220 kgf (kilograms-force), achieving reduction of the attractive force down to the order of the weight of the undulator magnet array itself. The undulator magnet array $1_C$, while exhibiting a repulsive force exceeding an attractive force in a region of larger gaps, exhibited a magnetic force as low as about 400 kgf in terms of absolute value. The undulator magnet arrays $1_{REF}$, $1_B$, and $1_C$, all exhibited so weak a force in the left-right direction as to be regarded as zero.

Figure 13:
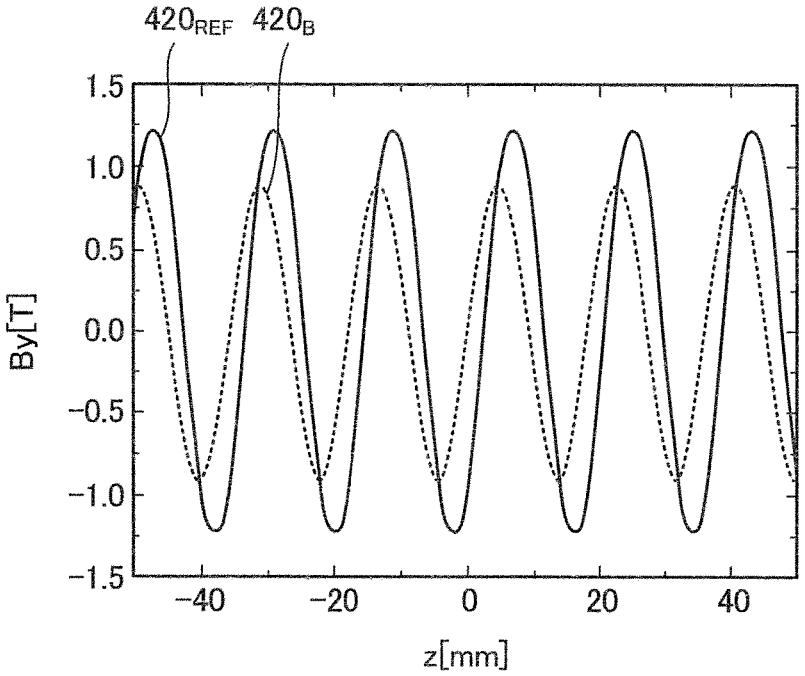
FIG. 13 is a diagram showing the results of simulations according to the first embodiment of the present invention.

FIG. 13 shows the magnetic field distribution in the undulator magnet array with a gap of 3 mm under the simulation conditions (computation conditions) mentioned above. In FIG. 13, the horizontal axis is a scale of the position (z) in the Z-axis direction, and the vertical axis is a scale of the Y-axis component By of the undulator magnetic field B. The solid-line curve $420_{REF}$ represents the variation of the magnetic field By against the variation of the position in the Z-axis direction in the undulator magnet array $1_{REF}$, and the solid-line curve $420_B$ represents the variation of the magnetic field By against the variation of the position in the Z-axis direction in the undulator magnet array $1_B$. Though not shown in FIG. 13, the undulator magnet array $1_C$ exhibited a curve approximately similar to the solid-line curve $420_B$.

It is seen that, while the intensity of the magnetic field produced by the undulator magnet array $1_B$ (or $1_C$) is about 75% of that produced by the undulator magnet array REF, the undulator magnet array $1_B$ (or $1_C$) produced a magnetic field with sufficient intensity and satisfactory periodicity. It is known that, in a Halbach magnet array, the magnetic attractive force is proportional to the square of the intensity of the undulator magnetic field B. With the undulator magnet array $1_{REF}$, even when the intensity of the undulator magnetic field B is reduced to about 75% of that in the state in FIG. 13, 50% or more of the original attractive force remains (for example, an attractive force of "5.4 tons×$0.75^2$" remains). Thus, even with consideration given to the drop of the magnetic field intensity resulting from the shifting of magnet arrays, the undulator magnet array $1_B$ (or $1_C$) turns out to be superior.

Second Embodiment

A second embodiment of the present invention will be described. The second embodiment, as well as the third to fifth embodiments described later, is based on the first embodiment, and to the features of the second to fifth embodiments that go unmentioned in the following description, the description of the corresponding features in the first embodiment applies unless inconsistent. Features from different ones of the first to fifth embodiments may be combined together unless inconsistent.

The amount of leftward shift Δz (example of predetermined shift amount) of the upper shifted magnet array relative to the lower reference magnet array will be defined in terms of the phase φz. The amount of leftward shift of the lower shifted magnet array relative to the upper reference magnet array also equals Δz. The phase φz corresponding to one period $\lambda_u$ equals 2π in radian notation. Therefore, the phase φz is given by "$\varphi z=2\pi\times\Delta z/\lambda_u$". In the undulator magnet array $1_{REF}$, no shifting as described above is involved, and thus, in the undulator magnet array $1_{REF}$, "φz=0". In the undulator magnet arrays $1_A$, $1_B$, $1_C$, and $1_D$ described above, the shift amount Δz equals one-fourth of the period $\lambda_u$, and thus "φz=π/2". In the undulator magnet array in FIG. 5, the shift amount Δz equals one-half of the period $\lambda_u$, and thus "φz=π".

Figure 14:
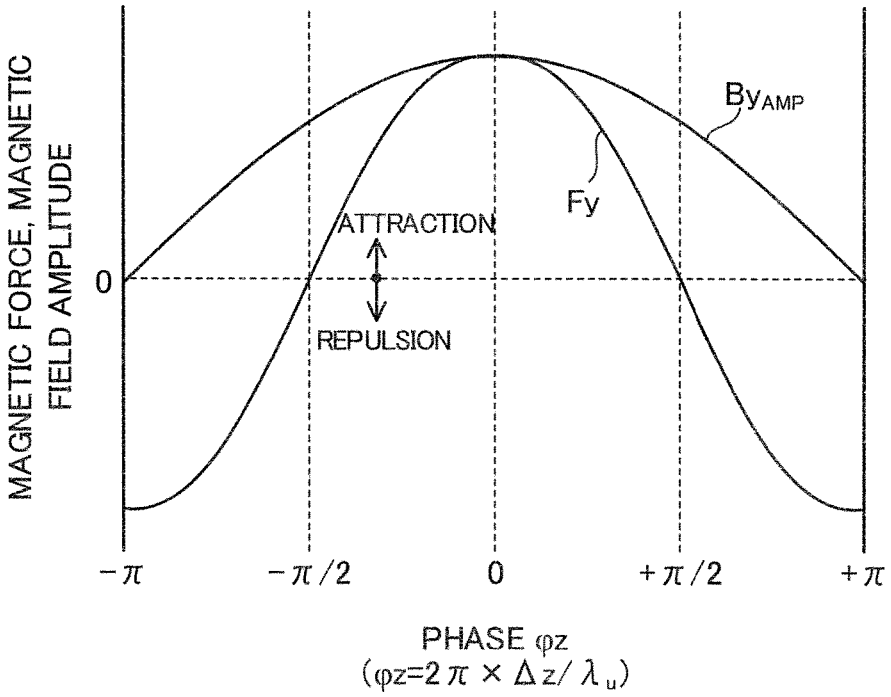
FIG. 14 is a diagram showing the phase-dependence of the magnetic force that acts between the upper and lower magnet arrays and the phase-dependence of the amplitude of the magnetic field produced by the upper and lower magnet arrays in a second embodiment of the present invention.

In FIG. 14, the curve Fy represents the magnetic force in the Y-axis direction that acts between the upper and lower magnet arrays. In FIG. 14, the shift amount Δz by which the upper shifted magnet array is shifted rightward relative to the lower reference magnet array is assumed to be negative. The magnetic force Fy in the Y-axis direction is an attractive force when "$-\pi/2<\varphi z<\pi/2$", and is a repulsive force when "$-\pi\leq\varphi z<-\pi/2$" or "$\pi/2<\varphi z\leq\pi$". The magnetic force Fy in the Y-axis direction as an attractive force is at its maximum when "φz=0", and decreases toward zero as the phase φz increases or decreases from 0 toward π/2 or (−π/2). The magnetic force Fy in the Y-axis direction as a repulsive force is at its maximum when "φz=π", and decreases toward zero as the phase φz decreases from π toward π/2 or increases from (−π) toward (−π/2).

In FIG. 14, the curve $By_{AMP}$ represents the magnitude of the amplitude of the Y-axis component of the undulator magnetic field B. The magnitude $By_{AMP}$ of the amplitude of the Y-axis component of the undulator magnetic field B is at its maximum when the phase φz equals 0, and decreases toward 0 as the phase φz increases or decreases from 0 to π or (−π).

The magnetic force Fy in the Y-axis direction and the magnitude $By_{AMP}$ of the amplitude of the Y-axis component of the undulator magnetic field B do not rely on the polarity of the phase φz but is determined only by the absolute value of the phase φz, and accordingly the following description focuses on the range of "0≤φz≤π".

The first embodiment places emphasis on the cancelling-out of the attractive and repulsive forces, and proposes an undulator magnet array ($\mathbf{1}_A$, $\mathbf{1}_B$, $\mathbf{1}_C$, or $\mathbf{1}_D$) such that "φz=π/2". Instead, an undulator magnet array may be formed such that the phase φz equals neither zero nor π/2. Specifically, the undulator magnet array 1 may be formed by use of an arbitrary shift amount Δz that fulfills, for example, "0<φz<π".

In generalized terms, an undulator magnet array $\mathbf{1}_{GN}$ (unillustrated) according to the second embodiment, which is an example of the undulator magnet array 1, includes an upper magnet array formed by coupling together an upper shifted magnet array and an upper reference magnet array each composed of a plurality of magnets 30 and a lower magnet array formed by coupling together a lower reference magnet array and a lower shifted magnet array each composed of a plurality of magnets 30, wherein the upper shifted magnet array is disposed opposite the lower reference magnet array, the upper shifted magnet array being shifted relative to the lower reference magnet array by a predetermined shift amount Δz in a predetermined direction (in the example in FIG. 6, in the leftward direction) parallel to the magnet arrangement direction as compared with in a reference state (hereinafter referred to as the maximized magnetic-field state, which occurs when φz=0) where the amplitude of the periodic magnetic field produced by the upper and lower magnet arrays is maximized, and the lower shifted magnet array is disposed opposite the upper reference magnet array, the lower shifted magnet array being shifted relative to the upper reference magnet array by a predetermined shift amount Δz in a predetermined direction (in the example in FIG. 6, in the leftward direction) parallel to the magnet arrangement direction as compared with in the maximized magnetic-field state.

The undulator magnet array $\mathbf{1}_A$, $\mathbf{1}_B$, $\mathbf{1}_C$, or $\mathbf{1}_D$ according to the first embodiment is a type of undulator magnet array $\mathbf{1}_{GN}$, and undulator magnet arrays according to the third and fourth embodiments described later also belong to the undulator magnet array $\mathbf{1}_{GN}$.

In the undulator magnet array $\mathbf{1}_{GN}$, the shift amount Δz is determined so as to fulfill "0<φz<π". That is, the shift amount Δz is less than one-half of the period $\lambda_u$ of the change of the magnetization direction of the magnets 30. Thus, as compared with the undulator magnet array $\mathbf{1}_{REF}$ where "φz=0", it is possible to reduce the magnitude of the magnetic force (attractive or repulsive force) that occurs between the upper and lower magnet arrays, and it is thus possible to obtain effects and benefits as mentioned in the description of, among others, the first and second improved configurations of the first embodiment.

However, with the phase φz close to 0 or close to π, it is difficult to obtain substantial benefits. Accordingly, for example, in the undulator magnet array $\mathbf{1}_{GN}$, it is preferable that the shift amount Δz be determined so as to fulfill "π/4≤φz≤3π/4". That is, it is preferable that the shift amount Δz be one-eighth or more but three-eighths or less of the period $\lambda_u$.

Typically, for example, as in the undulator magnet array $\mathbf{1}_A$, $\mathbf{1}_B$, $\mathbf{1}_C$, or $\mathbf{1}_D$ according to the first embodiment, in the undulator magnet array $\mathbf{1}_{GN}$, it is preferable that the shift amount Δz be determined so as to fulfill "φz=π/2". That is, it is preferable that the shift amount Δz be one-fourth of the period $\lambda_u$. This maximizes the effect of reducing the magnitude of the magnetic force that occurs between the upper and lower magnet arrays. Here, defining the shift amount Δz to be one-fourth of the period $\lambda_u$ should be understood not to preclude allowing for a slight margin to accommodate an error. As mentioned in the description of the fourth improved configuration of the first embodiment, the gap-dependence of the attractive force and the gap-dependence of the repulsive force, even if the difference between them is slight, do differ from each other. To cope with that, the shift amount Δz may be deviated slightly from one-fourth of the period $\lambda_u$. Even with this deviation, it is possible to consider the shift amount Δz substantially equal to one-fourth of the period $\lambda_u$, and it is possible to consider that the deviation permits the shift amount Δz to be in the range of one-eighth or more but three-eighths or less of the period $\lambda_u$.

As described previously with reference to FIG. 7, in the upper shifted magnet array in the undulator magnet array $\mathbf{1}_{GN}$, in a region (corresponding to the to-be-interpolated region 330 in FIG. 7) within the distance corresponding to the shift amount Δz from the upper reference magnet array neighboring, on the right of, the upper shifted magnet array, the magnet 30 of which the magnetization direction is determined based on the magnetization direction of a magnet 30 in the upper reference magnet array is disposed. This helps preserve the periodicity of the undulator magnetic field B. More specifically, in the above-mentioned region (corresponding to the to-be-interpolated region 330 in FIG. 7), the magnet 30 with the same magnetization direction as the magnet 30 in the predetermined region (corresponding to the interpolation-source region 340 in FIG. 7) in the upper reference magnet array is disposed. The predetermined region here (corresponding to the interpolation-source region 340 in FIG. 7) is the region between, of opposite ends of the upper reference magnet array, the end closer to the upper shifted magnet array (that is, the left end of the upper magnet array 320 in FIG. 7) and the position displaced from that end rightward by the shift amount Δz.

Like the undulator magnet array $\mathbf{1}_C$ or $\mathbf{1}_D$ of the first embodiment, the undulator magnet array $\mathbf{1}_{GN}$ may include a plurality of upper shifted magnet arrays, a plurality of upper reference magnet arrays, a plurality of lower shifted magnet arrays, and a plurality of lower reference magnet arrays. In this way, it is possible to distribute the compressive and tensile forces that act on the structural components (such as the magnet array beams 110 and 120 in FIG. 19 referred to later) that hold the magnet arrays integrally, and it is thus possible to reduce the rigidity required in those structural components. In that case, in the upper magnet array, the upper shifted and reference magnet arrays are coupled together alternately, and in the lower magnet array, the lower reference and shifted magnet arrays are coupled together alternately.

Third Embodiment

A third embodiment of the present invention will be described. Although the first embodiment assumes that the number M of magnets 30 present in one period $\lambda_u$ is four, it is also possible to form an undulator magnet array 1 where M is other than four. As examples, undulator magnet arrays 1 where M=2 or M=8 will be described below, with no intention of excluding undulator magnet arrays 1 where M is other than 2, 4, and 8.

Figure 15:
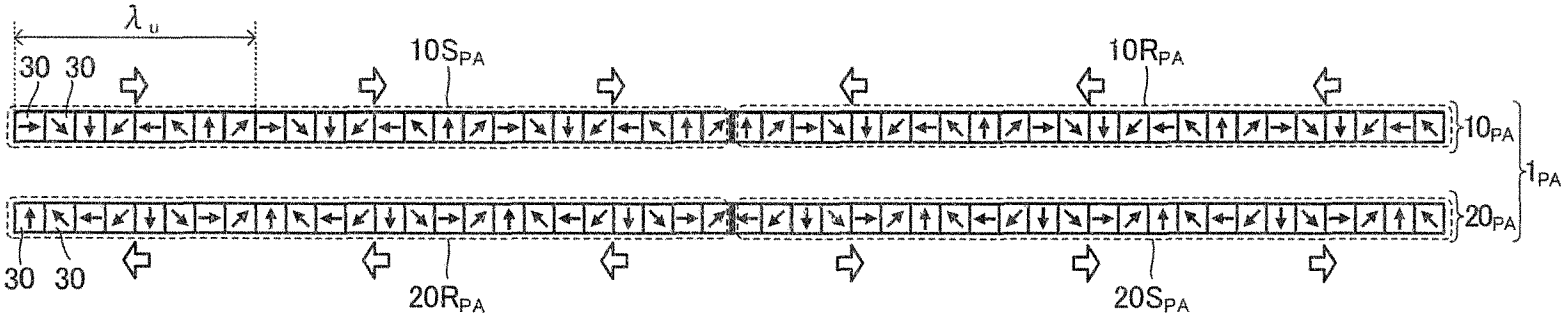
FIG. 15 is a diagram showing the configuration of an undulator magnet array with M=8 according to a third embodiment of the present invention.

FIG. 15 is a diagram showing the configuration of an undulator magnet array $\mathbf{1}_{PA}$ formed with M=8. The undulator magnet array $\mathbf{1}_{PA}$ is an example of the undulator magnet array 1, and includes an upper magnet array $\mathbf{10}_{PA}$ and a lower magnet array $\mathbf{20}_{PA}$ as an example of the upper and lower magnet arrays 10 and 20 respectively. The upper magnet array $\mathbf{10}_{PA}$ is formed by coupling together one upper shifted magnet array $\mathbf{10}S_{PA}$ and one upper reference magnet array $\mathbf{10}R_{PA}$. The lower magnet array $\mathbf{20}_{PA}$ is formed by coupling together one lower reference magnet array $\mathbf{20}R_{PA}$, which is disposed opposite the upper shifted magnet array $\mathbf{10}S_{PA}$, and one lower shifted magnet array $\mathbf{20}S_{PA}$, which is disposed opposite the upper reference magnet array $\mathbf{10}R_{PA}$.

Figure 16:
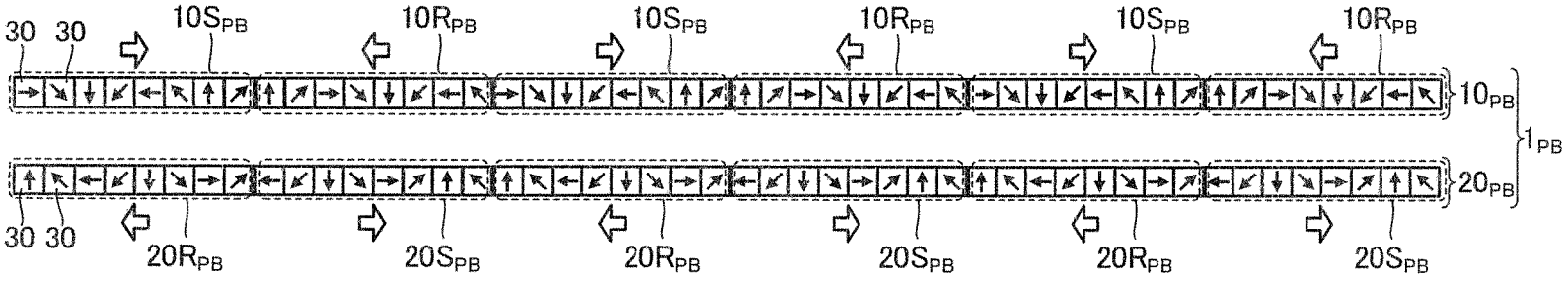
FIG. 16 is a diagram showing the configuration of another undulator magnet array with M=8 according to the third embodiment of the present invention.

FIG. 16 is a diagram showing the configuration of another undulator magnet array $\mathbf{1}_{PB}$ formed with M=8. The undulator magnet array $\mathbf{1}_{PB}$ is an example of the undulator magnet array 1, and includes an upper magnet array $\mathbf{10}_{PB}$ and a lower magnet array $\mathbf{20}_{PB}$ as an example of the upper and lower magnet arrays 10 and 20 respectively. The upper magnet array $\mathbf{10}_{PB}$ is formed by coupling together a plurality of upper shifted magnet arrays $\mathbf{10}S_{PB}$ and a plurality of upper reference magnet arrays $\mathbf{10}R_{PB}$. The lower magnet array $\mathbf{20}_{PB}$ is formed by coupling together a plurality of lower reference magnet arrays $\mathbf{20}R_{PB}$ and a plurality of lower shifted magnet array $\mathbf{20}S_{PB}$. As in a case with M=4 (that is, as in the third improved configuration of the first embodiment), in the upper magnet array $\mathbf{10}_{PB}$, the upper shifted magnet arrays $\mathbf{10}S_{PB}$ and the upper reference magnet arrays $\mathbf{10}R_{PB}$ are disposed alternately, and in the lower magnet array $\mathbf{20}_{PB}$, the lower shifted magnet arrays $\mathbf{20}S_{PB}$ and the lower reference magnet arrays $\mathbf{20}R_{PB}$ are disposed alternately; in addition, the upper shifted magnet arrays $\mathbf{10}S_{PB}$ are each disposed opposite one of the lower reference magnet array $\mathbf{20}R_{PB}$, and the lower shifted magnet arrays $\mathbf{20}S_{PB}$ are each disposed opposite one of the upper reference magnet arrays $\mathbf{10}R_{PB}$.

In the undulator magnet array $\mathbf{1}_{PA}$ in FIG. 15 and in the undulator magnet array $\mathbf{1}_{PB}$ in FIG. 16, M=8, and thus the period $\lambda_u$ equals "M×d=8×d" (see FIG. 3C); in each of the upper shifted, upper reference, lower shifted, and lower reference magnet arrays, the magnetization direction of the magnets 30 changes, in YZ-plane, by 45° (=360°/M) from one magnet to the next along the direction parallel to Z-axis. However, the direction of the change is opposite between the upper and lower magnet arrays.

In the undulator magnet array $\mathbf{1}_{PA}$ in FIG. 15 and in the undulator magnet array $\mathbf{1}_{PB}$ in FIG. 16, the shift amount $\Delta z$ equals $\lambda_u/4$, which corresponds to $\varphi z=\pi/2$. However, as mentioned in connection with the second embodiment, the shift amount $\Delta z$ in them may instead be set at other than one-fourth of the period $\lambda_u$. In the undulator magnet array $\mathbf{1}_{PB}$ in FIG. 16, one upper shifted magnet array, one upper reference magnet array, one lower shifted magnet array, and one lower reference magnet array are each composed of magnets corresponding to one period, they may instead be each composed of magnets corresponding to a plurality of (for example, ten) periods.

Figure 17:
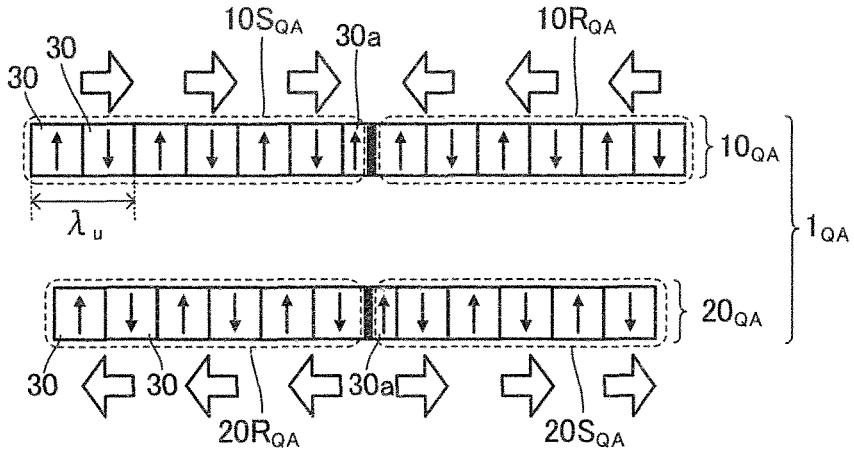
FIG. 17 is a diagram showing the configuration of an undulator magnet array with M=2 according to the third embodiment of the present invention.

FIG. 17 is a diagram showing the configuration of an undulator magnet array $\mathbf{1}_{QA}$ formed with M=2. The undulator magnet array $\mathbf{1}_{QA}$ is an example of the undulator magnet array 1, and includes an upper magnet array $\mathbf{10}_{QA}$ and a lower magnet array $\mathbf{20}_{QA}$ as an example of the upper and lower magnet arrays 10 and 20 respectively. The upper magnet array $\mathbf{10}_{QA}$ is formed by coupling together one upper shifted magnet array $\mathbf{10}S_{QA}$ and one upper reference magnet array $\mathbf{10}R_{QA}$. The lower magnet array $\mathbf{20}_{QA}$ is formed by coupling together one lower reference magnet array $\mathbf{20}R_{QA}$, which is disposed opposite the upper shifted magnet array $\mathbf{10}S_{QA}$, and one lower shifted magnet array $\mathbf{20}S_{QA}$, which is disposed opposite the upper reference magnet array $\mathbf{10}R_{QA}$.

Figure 18:
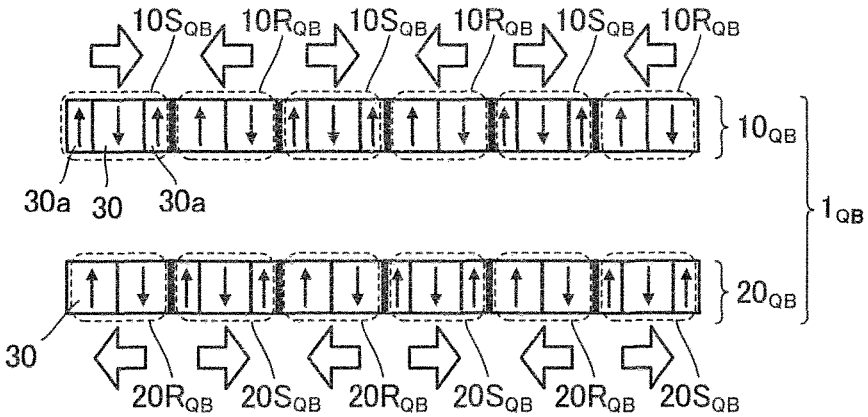
FIG. 18 is a diagram showing the configuration of another undulator magnet array with M=2 according to the third embodiment of the present invention.

FIG. 18 is a diagram showing the configuration of another undulator magnet array $\mathbf{1}_{QB}$ formed with M=2. The undulator magnet array $\mathbf{1}_{QB}$ is an example of the undulator magnet array 1, and includes an upper magnet array $\mathbf{10}_{QB}$ and a lower magnet array $\mathbf{20}_{QB}$ as an example of the upper and lower magnet arrays 10 and 20 respectively. The upper magnet array $\mathbf{10}_{QB}$ is formed by coupling together a plurality of upper shifted magnet arrays $\mathbf{10}S_{QB}$ and a plurality of upper reference magnet arrays $\mathbf{10}R_{QB}$. The lower magnet array $\mathbf{20}_{QB}$ is formed by coupling together a plurality of lower reference magnet arrays $\mathbf{20}R_{QB}$ and a plurality of lower shifted magnet array $\mathbf{20}S_{QB}$. As in a case with M=4 (that is, as in the third improved configuration of the first embodiment), in the upper magnet array $\mathbf{10}_{QB}$, the upper shifted magnet arrays $\mathbf{10}S_{QB}$ and the upper reference magnet arrays $\mathbf{10}R_{QB}$ are disposed alternately, and in the lower magnet array $\mathbf{20}_{QB}$, the lower shifted magnet arrays $\mathbf{20}S_{QB}$ and the lower reference magnet arrays $\mathbf{20}R_{QB}$ are disposed alternately; in addition, the upper shifted magnet arrays $\mathbf{10}S_{QB}$ are each disposed opposite one of the lower reference magnet array $\mathbf{20}R_{QB}$, and the lower shifted magnet arrays $\mathbf{20}S_{QB}$ are each disposed opposite one of the upper reference magnet arrays $\mathbf{10}R_{QB}$.

In the undulator magnet array $\mathbf{1}_{QA}$ in FIG. 17 and in the undulator magnet array $\mathbf{1}_{QB}$ in FIG. 18, M=2, and thus the period $\lambda_u$ equals "M×d=2×d" (see FIG. 3B); in each of the upper shifted, upper reference, lower shifted, and lower reference magnet arrays, the magnetization direction of the magnets 30 changes, in YZ-plane, by 180° (=360°/M) from one magnet to the next along the direction parallel to Z-axis.

In the undulator magnet array $\mathbf{1}_{QA}$ in FIG. 17 and in the undulator magnet array $\mathbf{1}_{QB}$ in FIG. 18, the shift amount $\Delta z$ equals $\lambda_u/4$, which corresponds to $\varphi z=\pi/2$. With M=2, the width in the Z-axis direction of magnets corresponding to one-fourth of the period $\lambda_u$ equals one half of the width d of the magnet 30. A magnet of which the width in the Z-axis direction equals d/2, that is, a magnet half the size of the magnet 30 will be identified as a magnet 30*a*. Two magnets 30*a* correspond to one magnet 30. In each of the upper shifted magnet arrays ($\mathbf{10}S_{QA}$, $\mathbf{10}S_{QB}$) and the lower shifted magnet arrays ($\mathbf{20}S_{QA}$, $\mathbf{20}S_{QB}$) in FIGS. 17 and 18, the shifting by $\lambda_u/4$ results in partial use of magnets 30*a*. The shift amount $\Delta z$ in the undulator magnet array $\mathbf{1}_{QA}$ in FIG. 17 and in the undulator magnet array $\mathbf{1}_{QB}$ in FIG. 18 may, as mentioned in connection with the second embodiment, instead be set at other than one-fourth of the period $\lambda_u$. In the undulator magnet array $\mathbf{1}_{QB}$ in FIG. 18, one upper shifted magnet array, one upper reference magnet array, one lower shifted magnet array, and one lower reference magnet array are each composed of magnets corresponding to one period, they may instead be each composed of magnets corresponding to a plurality of (for example, ten) periods.

Fourth Embodiment

Figure 19:
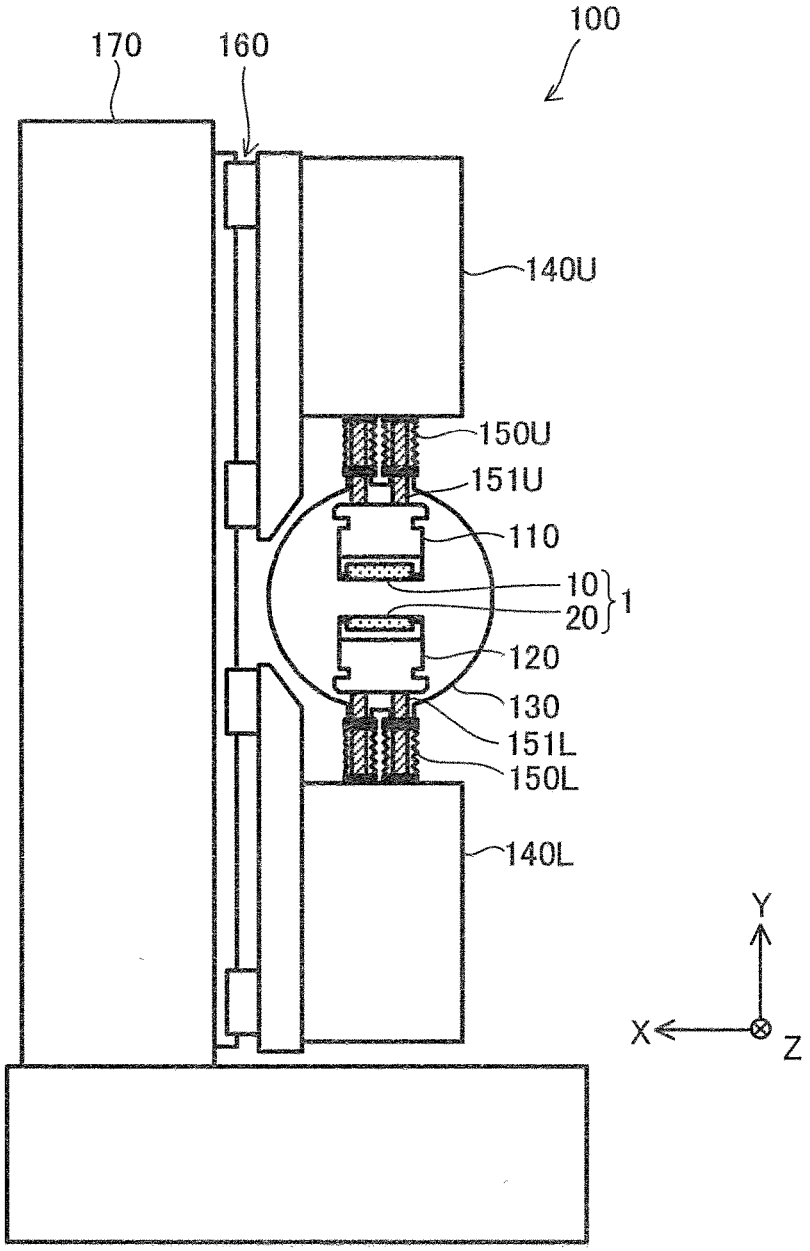
FIG. 19 is a side view of an undulator according to a fourth embodiment of the present invention.

A fourth embodiment of the present invention will be described. FIG. 19 shows an undulator (undulating equipment) 100 according to the fourth embodiment.

The undulator 100 includes the following components: an undulator magnet array 1 including an upper magnet array 10 and a lower magnet array 20; a magnet array beam 110 which holds the upper magnet array 10 integrally; a magnet array beam 120 which holds the lower magnet array 20 integrally; a vacuum chamber 130 which keeps in a vacuum state the space that encloses the undulator magnet array 1 and the magnet array beams 110 and 120; a high-rigidity beam 140U which is disposed over the vacuum chamber 130 and which supports the upper magnet array 10 and the magnet array beam 110 from above; a high-rigidity beam 140L which is disposed under the vacuum chamber 130 and which supports the lower magnet array 20 and the magnet array beam 120 from below; a vacuum introduction coupler 150U which couples together the high-rigidity beam 140U and the magnet array beam 110 by use of shafts 151U while keeping the vacuum state in the vacuum chamber 130; a vacuum introduction coupler 150L which couples together the high-rigidity beam 140L and the magnet array beam 120 by use of shafts 151L while keeping the vacuum state in the vacuum chamber 130; a ball screw driving mechanism 160 which is a driving mechanism coupled to the high-rigidity beams 140U and 140L and which enables, by use of a ball screw, the high-rigidity beams 140U and 140L to move in the up-down direction; and a base 170 to which the ball screw driving mechanism 160 is fitted and which has a substantially L-shaped sectional shape. A vacuum state in the vacuum chamber 130 denotes a state close to a vacuum, and may be any state with a barometric pressure at least lower than the atmospheric pressure.

Figure 20:
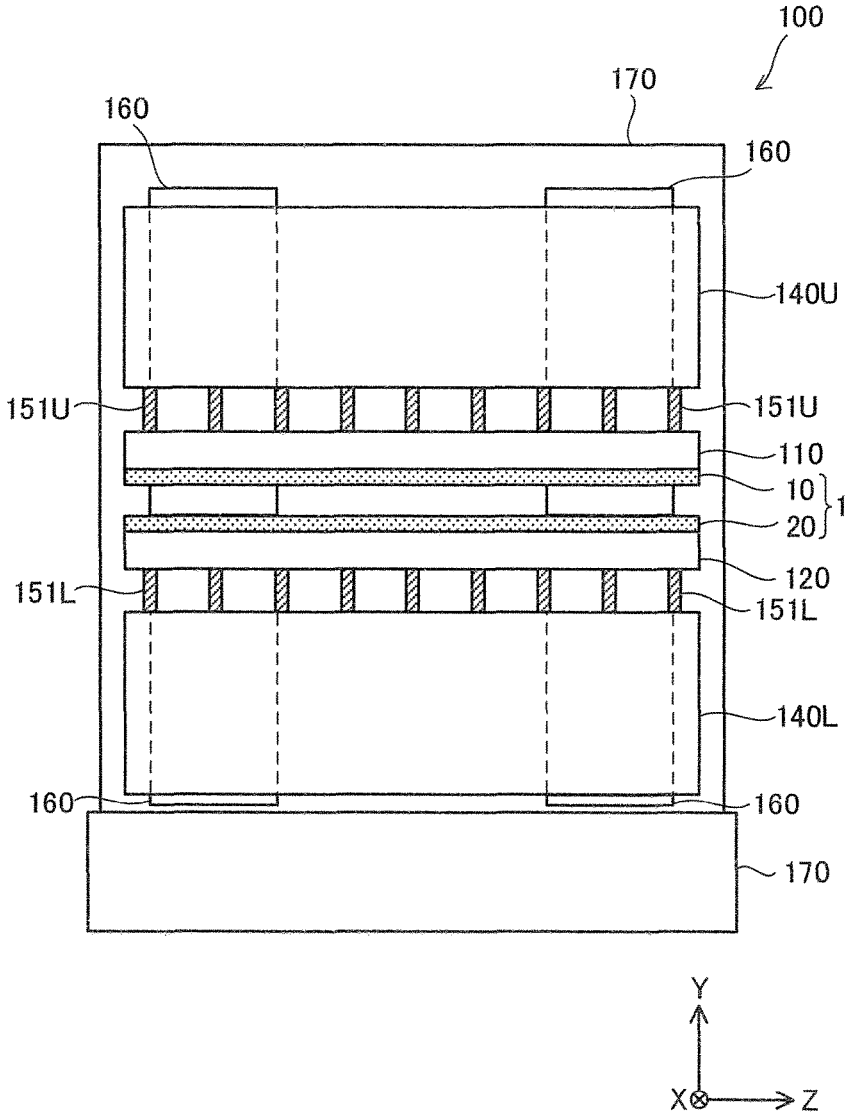
FIG. 20 is a front view of the undulator according to the fourth embodiment of the present invention.

FIG. 20 is a front view of the undulator 100. In FIG. 20, for the sake of convenient illustration, the vacuum chamber 130 is omitted. Moreover, in FIG. 20, of all the constituent elements of the vacuum introduction couplers 150U and 150L, only a plurality of shafts 151U which physically couple together the high-rigidity beam 140U and the magnet array beam 110 and a plurality of shafts 151L which physically couple together the high-rigidity beam 140L and the magnet array beam 120 are shown.

According to control signals from an unillustrated controller, the ball screw driving mechanism 160 can, by moving both the high-rigidity beams 140U and 140L individually in the up-down direction, or by moving one of the high-rigidity beams 140U and 140L in the up-down direction, vary the gap between the upper and lower magnet arrays 10 and 20. More specifically, for example, the ball screw driving mechanism 160 can, by moving the high-rigidity beam 140U upward and the high-rigidity beam 140L downward by the same amount, increase the gap between the upper and lower magnet arrays 10 and 20, and can, by moving the high-rigidity beam 140U downward and the high-rigidity beam 140L upward by the same amount, decrease the gap between the upper and lower magnet arrays 10 and 20. Thus, it can be said that the undulator 100 is provided with a holder which holds the undulator magnet array 1 such that the gap (interval) between the upper and lower magnet arrays 10 and 20 is variable. The holder can be considered to include the magnet array beams 110 and 120, the high-rigidity beams 140U and 140L, the vacuum introduction couplers 1500 and 150L, the ball screw driving mechanism 160, and the base 170.

Figure 21:
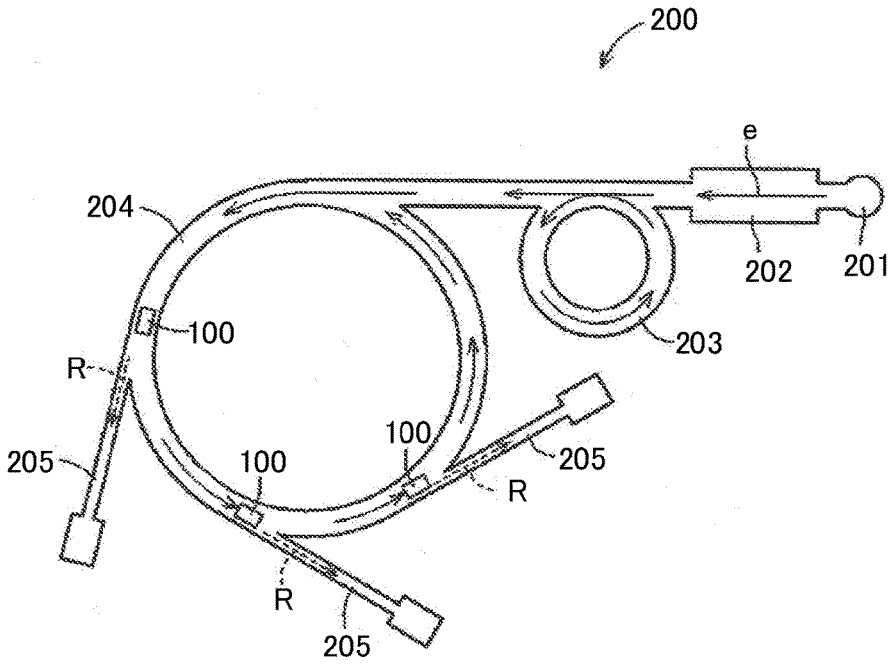
FIG. 21 is a plan view of a synchrotron radiation facility according to the fourth embodiment of the present invention.
Figure 22:
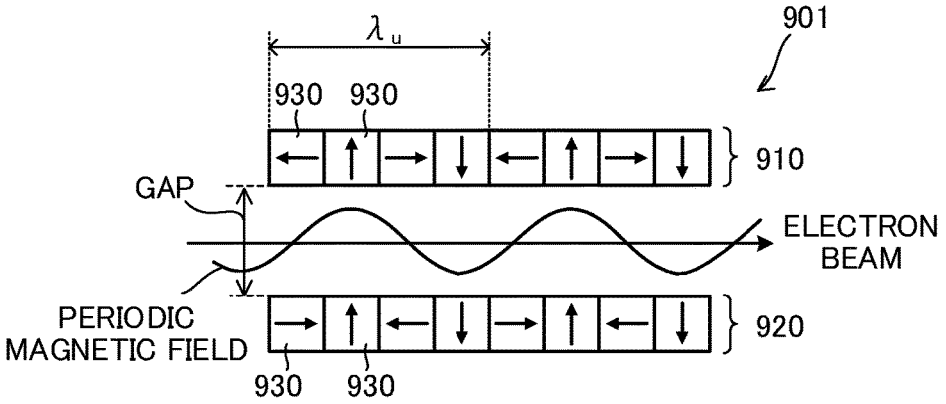
FIG. 22 is a diagram showing the configuration of a conventional undulator magnet array.

FIG. 21 is a plan view schematically showing a synchrotron radiation facility 200. The synchrotron radiation facility 200 includes an electron gun 201, a linear accelerator 202, a synchrotron 203, a storage ring 204, and one or more beam lines 205. In the storage ring 204, near a base part of each beam line 205, an undulator 100 is disposed.

Electrons e are emitted from the electron gun 201, are accelerated to a speed corresponding to an energy of about 1 GeV (gigaelectronvolts) by the linear accelerator 202, are then further accelerated to a speed corresponding to an energy of about 8 GeV by the synchrotron 203 using radio-frequency waves, and then enter the storage ring 204 at a speed close to that of light.

The electrons e circulate inside the storage ring 204 while maintaining their energy, and are undulated by the periodic magnetic field produced by the undulator magnet array 1 disposed inside the storage ring 204 to emit synchrotron radiation R. The synchrotron radiation R enters a beam line 205, and is, inside the beam line 205, used for various research and practical purposes.

As described above, with the technology according to the first to fourth embodiments, it is possible to greatly reduce the magnetic attractive force between the upper and lower magnet arrays. It is thus possible to reduce the rigidity required in the structural components that support the upper and lower magnet arrays, and also to simplify the structure (including a driving mechanism) of an undulator and to greatly reduce the weight of the undulator as a whole. Consequently, it is possible to greatly save cost and time related to the manufacture and installation of the undulator.

Modifications

The embodiments of the present invention allow for many modifications made as necessary within the scope of the technical concept set forth in the appended claims. The embodiments described above are merely examples of how the present invention can be implemented, and the senses of the terms used to define the present invention and its features are not limited to those in which they are used in the description of the embodiments given above. All specific values mentioned in the above description are merely examples, and can naturally be altered to different values.

Although the above description deals with cases where the present invention is applied to a pair of magnet arrays (upper and lower magnet arrays) disposed opposite each other, similar configurations may be applied to various types of undulator magnet arrays and undulators (undulating equipment). For example, a Figure-8 undulator or a Spring-8 helical undulator includes three sets of magnet arrays (upper and lower magnet arrays), each set comprising a pair of magnet arrays disposed opposite each other, and the present invention can be applied to each of those sets. For another example, an Apple II undulator includes two sets of magnet arrays (upper and lower magnet arrays), each set comprising a pair of magnet arrays disposed opposite each other, and the present invention can be applied to each of those sets.

Although in the above embodiments, the magnet arrays 10 and 20 are assumed to be disposed side by side in the up-down direction, they may instead be disposed side by side in any direction (for example, in the left-right direction) other than the up-down direction.

LIST OF REFERENCE SIGNS

1, $\mathbf{1}_{REF}$, $\mathbf{1}_{A}$ to $\mathbf{1}_{D}$, $\mathbf{1}_{PA}$, $\mathbf{1}_{PB}$, $\mathbf{1}_{QA}$, $\mathbf{1}_{QB}$ undulator magnet array

10, $\mathbf{10}_{REF}$, $\mathbf{10}_{A}$ to $\mathbf{10}_{D}$, $\mathbf{10}_{PA}$, $\mathbf{10}_{PB}$, $\mathbf{10}_{QA}$, $\mathbf{10}_{QB}$ upper magnet array $\mathbf{10S}_{B}$ to $\mathbf{10S}_{D}$, $\mathbf{10S}_{PA}$, $\mathbf{10S}_{PB}$, $\mathbf{10S}_{QA}$, $\mathbf{10S}_{QB}$ upper shifted magnet array $\mathbf{10R}_{B}$ to $\mathbf{10R}_{D}$, $\mathbf{10R}_{PA}$, $\mathbf{10R}_{PB}$, $\mathbf{10R}_{QA}$, $\mathbf{10R}_{QB}$ upper reference magnet array

20, $\mathbf{20}_{REF}$, $\mathbf{20}_{A}$ to $\mathbf{20}_{D}$, $\mathbf{20}_{PA}$, $\mathbf{20}_{PB}$, $\mathbf{20}_{QA}$, $\mathbf{20}_{QB}$ lower magnet array $\mathbf{20S}_{B}$ to $\mathbf{20S}_{D}$, $\mathbf{20S}_{PA}$, $\mathbf{20S}_{PB}$, $\mathbf{20S}_{QA}$, $\mathbf{20S}_{QB}$ lower shifted magnet array $\mathbf{20R}_{B}$ to $\mathbf{20R}_{D}$, $\mathbf{20R}_{PA}$, $\mathbf{20R}_{PB}$, $\mathbf{20R}_{QA}$, $\mathbf{20R}_{QB}$ lower reference magnet array

30, 30*a* magnet

100 undulator

The invention claimed is:

1. An undulator magnet array comprising:

a first magnet array and a second magnet array disposed parallel to each other with an interval therebetween so as to lie opposite to each other, a magnetization direction of magnets contained in the first magnet array and a magnetization direction of magnets contained in the second magnet array changing, in a plane through the first and second magnet arrays, periodically along a magnet arrangement direction of the respective magnet arrays, wherein the first magnet array is formed by coupling together a first shifted magnet array and a first reference magnet array each containing a first plurality of magnets, and the second magnet array is formed by coupling together a second reference magnet array and a second shifted magnet array each containing a second plurality of magnets, the first shifted magnet array is disposed opposite the second reference magnet array, the first shifted magnet array being shifted relative to the second reference magnet array by a predetermined shift amount in a predetermined direction parallel to the magnet arrangement direction as compared with in a reference state where an amplitude of a periodic magnetic field produced by the first and second magnet arrays is maximized, and the second shifted magnet array is disposed opposite the first reference magnet array, the second shifted magnet array being shifted relative to the first reference magnet array by the predetermined shift amount in the predetermined direction as compared with in the reference state.

2. The undulator magnet array of claim 1, wherein the predetermined shift amount is less than one-half of a period of change of the magnetization direction, the period being common to the first and second magnet arrays.

3. The undulator magnet array of claim 2, wherein the predetermined shift amount is one-eighth or more but three-eighths or less of the period of change of the magnetization direction.

4. The undulator magnet array of claim 3, wherein the predetermined shift amount is one-fourth of the period of change of the magnetization direction.

5. The undulator magnet array of claim 1, wherein in the first shifted magnet array, in a region within a distance corresponding to the predetermined shift amount from the first reference magnet array, a magnet whose magnetization direction is determined based on the magnetization direction of the magnets in the first reference magnet array is disposed.

6. The undulator magnet array of claim 5, wherein in the region, a magnet having a same magnetization direction as a magnetization direction of a magnet in a predetermined region in the first reference magnet array is disposed, and the predetermined region is a region located between, of opposite ends of the first reference magnet array, an end closer to the first shifted magnet array and a position displaced from the end by the predetermined shift amount in a direction opposite to the predetermined direction.

7. The undulator magnet array of claim 1, wherein the first shifted magnet array comprises a plurality of first shifted magnet arrays, the first reference magnet array comprises a plurality of first reference magnet arrays, the second shifted magnet array comprises a plurality of second shifted magnet arrays, and the second reference magnet array comprises a plurality of second reference magnet arrays, and in the first magnet array, the first shifted magnet arrays and the first reference magnet arrays are coupled together alternately, and in the second magnet array, the second reference magnet arrays and the second shifted magnet arrays are coupled together alternately.

8. An undulator, comprising:

the undulator magnet array of claim 1; and a holder for holding the undulator magnet array such that a gap between the first and second magnet arrays in the undulator magnet array is variable.

* * * * *